US009102116B2

(12) United States Patent
Suzuki et al.

(10) Patent No.: US 9,102,116 B2
(45) Date of Patent: Aug. 11, 2015

(54) SHEET CREASER, SHEET FINISHER, IMAGE FORMING APPARATUS, SHEET FOLDING METHOD, AND COMPUTER PROGRAM PRODUCT

(75) Inventors: Nobuyoshi Suzuki, Tokyo (JP); Masahiro Tamura, Kanagawa (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Junichi Tokita, Kanagawa (JP); Takashi Saito, Kanagawa (JP); Akira Kunieda, Tokyo (JP); Hiroshi Maeda, Gifu (JP); Ichiro Ichihashi, Aichi (JP); Atsushi Kuriyama, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 652 days.

(21) Appl. No.: 12/385,118

(22) Filed: Mar. 31, 2009

(65) Prior Publication Data

US 2009/0258774 A1 Oct. 15, 2009

(30) Foreign Application Priority Data

Apr. 15, 2008 (JP) ..... 2008-105644

(51) Int. Cl.

| | |
|---|---|
| ***B65H 45/18*** | (2006.01) |
| ***B31F 1/10*** | (2006.01) |
| ***B31F 1/00*** | (2006.01) |
| ***B65H 45/30*** | (2006.01) |

(52) U.S. Cl.

CPC ..... *B31F 1/10* (2013.01); *B31F 1/0012* (2013.01); *B65H 45/18* (2013.01); *B65H 45/30* (2013.01); *B65H 2301/51232* (2013.01); *B65H 2701/13212* (2013.01); *B65H 2801/27* (2013.01)

(58) Field of Classification Search

CPC ..... B65H 45/18; B65H 45/12; B65H 45/101; B65H 45/22; B65H 45/30; B65H 45/163; B42D 15/008

USPC ..... 493/444, 442, 435, 434, 424, 427; 270/32, 51, 58.07, 58.11, 58.12

See application file for complete search history.

(56) References Cited

U.S. PATENT DOCUMENTS 5,044,617 A * 9/1991 Roberts ..... 270/45
5,169,376 A * 12/1992 Ries et al. ..... 493/445

(Continued)

FOREIGN PATENT DOCUMENTS

| | | |
|---|---|---|
| JP | 62-016987 | 1/1987 |
| JP | 3990256 | 7/2007 |
| JP | 4154318 | 7/2008 |

OTHER PUBLICATIONS

Abstract of JP 2004-149292 published May 27, 2004.

(Continued)

*Primary Examiner* — Sameh Tawfik

(74) *Attorney, Agent, or Firm* — Harness, Dickey & Pierce, P.L.C.

(57) ABSTRACT

In a sheet creaser, a sheet set is pushed between a pair of folding rollers to fold the sheet set. Then, a re-pressing roller re-presses the sheet set, which has been folded by the folding rollers, by rolling along the crease. Pressure applied on the sheet set by the folding rollers is released when the re-pressing roller re-presses the sheet set.

10 Claims, 31 Drawing Sheets

(56) References Cited

U.S. PATENT DOCUMENTS

| | | | | |
|---|---|---|---|---|
| 6,447,436 | B2 * | 9/2002 | Lindsay | 493/216 |
| 6,475,129 | B1 * | 11/2002 | Lehmann | 493/421 |
| 6,692,208 | B1 * | 2/2004 | Watkiss et al. | 412/1 |
| 7,416,177 | B2 | 8/2008 | Suzuki et al. | |
| 7,607,650 | B2 * | 10/2009 | Oikawa et al. | 270/58.07 |
| 7,905,473 | B2 * | 3/2011 | Tamura et al. | 270/32 |
| 2002/0065183 | A1 | 5/2002 | Luthi et al. | |
| 2006/0263174 | A1 | 11/2006 | Oikawa et al. | |
| 2007/0235917 | A1 | 10/2007 | Nagasako et al. | |
| 2008/0067730 | A1 | 3/2008 | Suzuki et al. | |
| 2008/0211162 | A1 | 9/2008 | Suzuki et al. | |
| 2008/0284092 | A1 | 11/2008 | Suzuki et al. | |
| 2009/0152789 | A1 * | 6/2009 | Kikkawa et al. | 270/45 |

OTHER PUBLICATIONS

Abstract of JP 2005-162345 published Jun. 23, 2005.

European Search Report dated Jun. 11, 2012 for corresponding European Patent Application No. 09250801.9-2308.

* cited by examiner

SHEET CREASER, SHEET FINISHER, IMAGE FORMING APPARATUS, SHEET FOLDING METHOD, AND COMPUTER PROGRAM PRODUCT

CROSS-REFERENCE TO RELATED APPLICATIONS

The present application claims priority to and incorporates by reference the entire contents of Japanese priority document 2008-105644 filed in Japan on Apr. 15, 2008.

BACKGROUND OF THE INVENTION

1. Field of the Invention

The present invention relates to a sheet creaser, a sheet finisher including the sheet creaser, an image forming apparatus including the sheet finisher, a sheet folding method, and a computer program product.

2. Description of the Related Art

Image-forming-apparatus connectable bookbinding machines that bind a set of sheets (hereinafter, "sheet set") by simple saddle stitch have been widely used. There are various needs in the bookbinding machine market such as a bookbinding machine capable of binding more sheets, a bookbinding machine capable of binding thicker sheets, and a bookbinding machine having a cutting function. To fulfill these needs, it is necessary to tightly fold the sheet set. In other words, it is necessary to make the crease stronger.

Re-pressing is a technique to make the crease stronger. The re-pressing means that pressing a folded side of the sheet set twice or more. There are two approaches in the re-pressing. The first approach is to press the folded side twice in the same direction. The second approach is to press the folded side twice in different directions (directions perpendicular to each other). In the first approach, a pair of folding rollers half-folds the sheet set with high pressure while rolling in one direction (positive direction). After that, the folding rollers re-press the folded sheet set while rolling in a reverse direction (negative direction). In the second approach, after the sheet set is passed through a nip between the folding rollers, a pressure roller re-presses the folded sheet set while rolling on the crease.

The second approach has better re-pressing performance, and therefore most of bookbinding systems emphasizing on productivity employ the second approach. In most of the bookbinding systems using the second approach, from the viewpoint of space saving, the pressure roller is arranged near the folding rollers to re-press the sheet set immediately after the folding rollers make the crease. After the pressure roller re-presses the sheet set, the folding rollers convey the sheet set to a tray out of the bookbinding system. A technology disclosed in Japanese Patent Application Laid-open No. 2005-162345 is an example of the second approach.

A sheet finisher disclosed in Japanese Patent Application Laid-open No. 2005-162345 receives the sheets on which images are formed and performs a finishing process on those sheets. The sheet finisher includes a guiding unit, a re-pressing unit, and a supporting unit, as salient features. The guiding unit guides, after the sheet set is aligned and half-folded, the folded sheet set, carrying the folded sheet set on a surface of the guiding unit. The re-pressing unit re-presses the folded side of the sheet set, moving in a direction perpendicular to a sheet conveying direction in which the guiding unit conveys the sheet set. The supporting member supports sides of the sheet set while the re-pressing unit is re-pressing the sheet set.

However, in some cases, especially when there are many sheets to be processed in one operation, the conventional sheet finisher cannot make the crease strong enough. It is considered that a manner of conveying the sheet set by the folding rollers affects the strength of the crease. The sheet set is tightly folded immediately after the folding rollers folds the sheets set. However, if the manner of conveying is poor, as shown in FIG. 28A, an inner surface of the folded sheet set gets wavy and the wavy inner surface causes the outer surface to expand. Therefore, a crease SH1 of the sheet set is weak. Even if the pressure roller re-presses the crease SH1 shown in FIG. 28A, because the crease SH1 is swollen, the crease SH1 cannot be strong enough.

A creaser disclosed in Japanese Patent No. 3990256 includes the folding rollers that fold the sheet or the sheet set passing through a nip between the folding rollers, a pressing unit that applies a pressure to the folding rollers when the folding rollers fold the sheet or the sheet set, a pressure changing unit that changes the applied pressure depending on a conveying state of the sheet or the sheet set. Components of the pressing unit are arranged substantially symmetrically with respect to the center of a conveyer path, through which the sheet or the sheet set passes, running through the nip between the folding rollers. The pressing unit includes a first elastic member that generates a first biasing force, a first transmission member that transmits the first biasing force to the folding rollers, a second elastic member that generates a second biasing force, a second transmission member that transmits the second biasing force to the folding rollers. The first biasing force is set smaller than the second biasing force. The pressure changing unit changes the pressure by switching between the first biasing force and the second biasing force.

In the creaser disclosed in Japanese Patent No. 3990256, when a leading end of the sheet enters the nip between the folding rollers, the pressure changing unit causes the first transmission member to transmit the first biasing force to the folding rollers. When the leading end passes the nip, the pressure changing unit causes the second transmission member to transmit the second biasing force to the folding rollers.

However, even in the creaser disclosed in Japanese Patent No. 3990256, the state when the re-pressing roller re-presses the sheet set is unchanged, i.e., the sheet is in the state as shown in FIG. 28A. Therefore, as described above, the creaser cannot make the crease strong enough.

SUMMARY OF THE INVENTION

It is an object of the present invention to at least partially solve the problems in the conventional technology.

According to an aspect of the present invention, there is provided a sheet creaser including a pair of folding rollers that folds a sheet set including at least one sheet by pressing the sheet set in a nip portion therebetween with a nip pressure while conveying the sheet set thereby making a crease on the sheet set; a folding plate that thrusts the sheet set in the nip portion between the folding rollers with an edge of the folding plate coming in contact with the sheet set where the sheet set is to be folded, the folding plate being arranged opposed to the folding rollers with respect to the sheet set; a re-pressing roller that receives a folded sheet set from the folding rollers and re-presses the sheet set by rolling along the crease thereby making the crease stronger; and a pressure releasing unit that performs a pressure releasing operation of releasing the nip pressure in the nip portion between the folding rollers when the re-pressing roller re-presses the crease.

According to another aspect of the present invention, there is provided a method of folding a sheet set including at least one sheet. The method including thrusting, with a folding plate, the sheet set into a nip portion between a pair of folding rollers by pushing the sheet set along a line at which the sheet set is to be folded thereby folding the sheet set; making a crease on folded sheet set with the folding rollers by applying a nip pressure to the sheet set; and re-pressing the folded sheet set by rolling along the crease thereby making the crease stronger in a pressure released state where no nip pressure is applied on the sheet set by the folding rollers.

According to still another aspect of the present invention, there is provided a computer program product that includes a computer-readable recording medium and computer program codes stored in the computer-readable recording medium, wherein when the computer program codes are executed on a computer cause the computer to execute a method of folding a sheet set on sheet creaser comprising a pair of folding rollers that folds a sheet set including at least one sheet by pressing the sheet set in a nip portion therebetween with a nip pressure while conveying the sheet set thereby making a crease on the sheet set; a folding plate that thrusts the sheet set in the nip portion between the folding rollers with an edge of the folding plate coming in contact with the sheet set where the sheet set is to be folded, the folding plate being arranged opposed to the folding rollers with respect to the sheet set; and a re-pressing roller that receives a folded sheet set from the folding rollers and re-presses the sheet set by rolling along the crease thereby making the crease stronger, the computer program codes causing the computer to execute thrusting, with a folding plate, the sheet set into a nip portion between a pair of folding rollers by pushing the sheet set along a line at which the sheet set is to be folded thereby folding the sheet set; making a crease on folded sheet set with the folding rollers by applying a nip pressure to the sheet set; and re-pressing the folded sheet set by rolling along the crease thereby making the crease stronger in a pressure released state where no nip pressure is applied on the sheet set by the folding rollers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
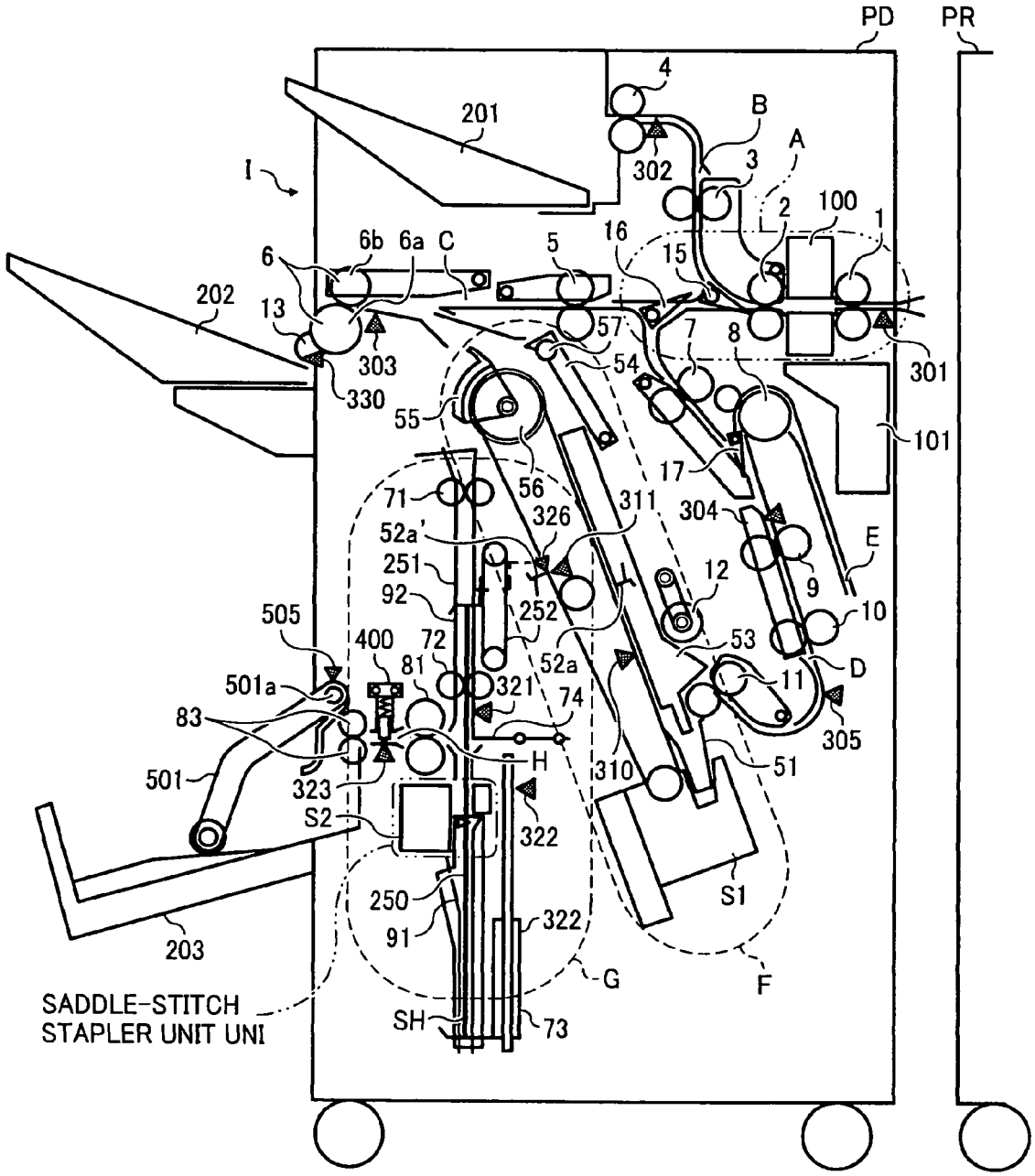
FIG. 1 is a schematic diagram of an image forming system including a sheet finisher, illustrated mainly, and an image forming apparatus according to an embodiment of the present invention.

FIG. 1 is a schematic diagram of an image forming system including a sheet finisher PD and a part of an image forming apparatus PR according to an embodiment of the present invention.

The sheet finisher PD is attached to a side of the image forming apparatus PR. A recording medium (hereinafter, "sheet") discharged out of the image forming apparatus PR is conveyed to the sheet finisher PD. The sheet passes through a conveyer path A for single-sheet processing (e.g., a punching unit 100 is located near the conveyer path A). After that, the sheet is conveyed by the operation of switching claws 15 and 16 to one of a conveyer path B connecting to an upper tray 201, a conveyer path C connecting to a shift tray 202, a conveyer path D connecting to a side-stitch tray F for alignment and stapling.

After the alignment and stapling is performed at the side-stitch tray F with the sheet that has been passed through the conveyer paths A and D, the sheet is conveyed by the operation of a junction-point guiding plate 54 and a movable guiding member 55 to either the conveyer path C connecting to the shift tray 202 or a saddle-stitch tray G for saddle-stitch and folding. If the sheet is conveyed to the saddle-stitch tray G, the sheet is folded or the like at the saddle-stitch tray G. The folded sheet is conveyed to a conveyer path H and discharged onto a lower tray 203. The conveyer path D is provided with a switching claw 17 that keeps a position as shown in FIG. 1 by support of a low load spring (not shown). After a trailing end of the sheet passes the switching claw 17 while the sheet is conveyed by rotation of a pair of conveyer rollers 7, the sheet is reversed along a pre-stack roller 8 by reverse-rotation of a pair of conveyer rollers 9, in some cases, together with reverse-rotation of at least one of a pair of conveyer rollers 10 and a pair of side-stitch-tray entrance rollers 11. Thus, the sheet is conveyed with the back end ahead to a sheet accommodating unit E for pre-stacking. When the next sheet is conveyed to the sheet accommodating unit E, the two sheets are conveyed out of the sheet accommodating unit E overlapped with each other. It is possible to convey three or more sheets overlapped with one another by repeating those operations.

An entrance sensor 301 that detects passage of the sheet coming from the image forming apparatus PR, a pair of entrance rollers 1, the punching unit 100, a punch-waste hopper 101, a pair of conveyer rollers 2, and the switching claws 15 and 16 are arranged near the conveyer path A in this order, with the entrance sensor 301 being closest to the image forming apparatus PR. The switching claws 15 and 16 keep positions as shown in FIG. 1 by support of springs (not shown). When corresponding solenoids (not shown) are turned ON, the switching claws 15 and 16 switch ON. The sheet is conveyed to one of the conveyer paths B, C, and D depending on a switching pattern of the switching claws 15 and 16.

When the sheet is to be conveyed to the conveyer path B, the solenoids are kept OFF, and thereby the switching claws 15 and 16 are in the positions shown in FIG. 1. As a result, the sheet is conveyed to the shift tray 201 though a pair of conveyer rollers 3 and a pair of upper-tray sheet-discharge rollers 4. When the sheet is to be conveyed to the conveyer path C, the both solenoids are turned ON so that the switching claw 15 turns upward and the switching claw 16 turns downward. Thus, the sheet is conveyed to the shift tray 202 through a pair of shift-tray sheet-discharge rollers 6 (6*a*, 6*b*). When the sheet is to be conveyed to the conveyer path D, the solenoid for the switching claw 16 is turned OFF and the solenoid for the switching claw 15 is turned ON so that the switching claw 15 turns upward and the switching claw 16 remains in the position shown in FIG. 1.

The sheet finisher PD can perform various sheet processing including punching using the punching unit 100, alignment and side stitch using a pair of jogger fences 53 (53*a*, 53*b*) and a side-stitch stapler S1, sorting using the shift tray 202, and alignment, saddle stitch, and half folding using upper and lower saddle-stitch jogger fences 250, a saddle-stitch stapler unit UNI, a folding plate 74, and a pair of folding rollers 81 (81*a*, 81*b*).

Figure 2:
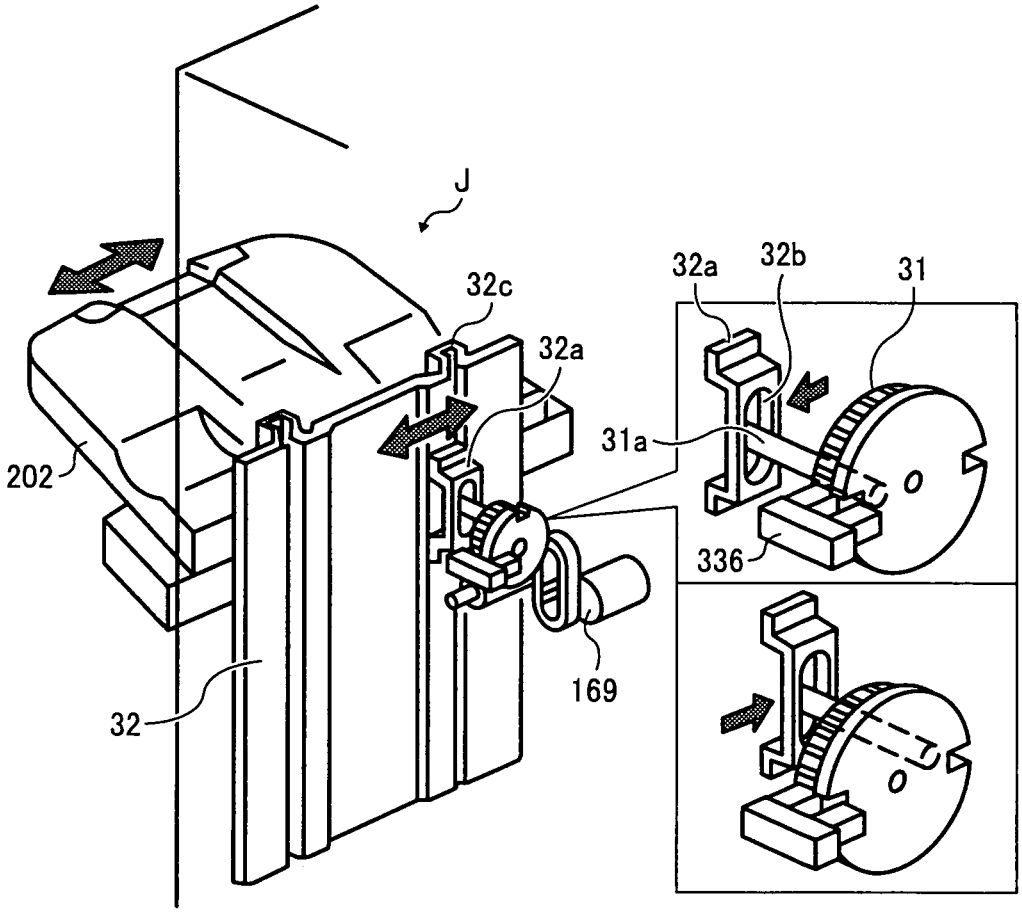
FIG. 2 is an enlarged perspective view of relevant parts of a mechanism that shifts a shift tray shown in FIG. 1.
Figure 3:
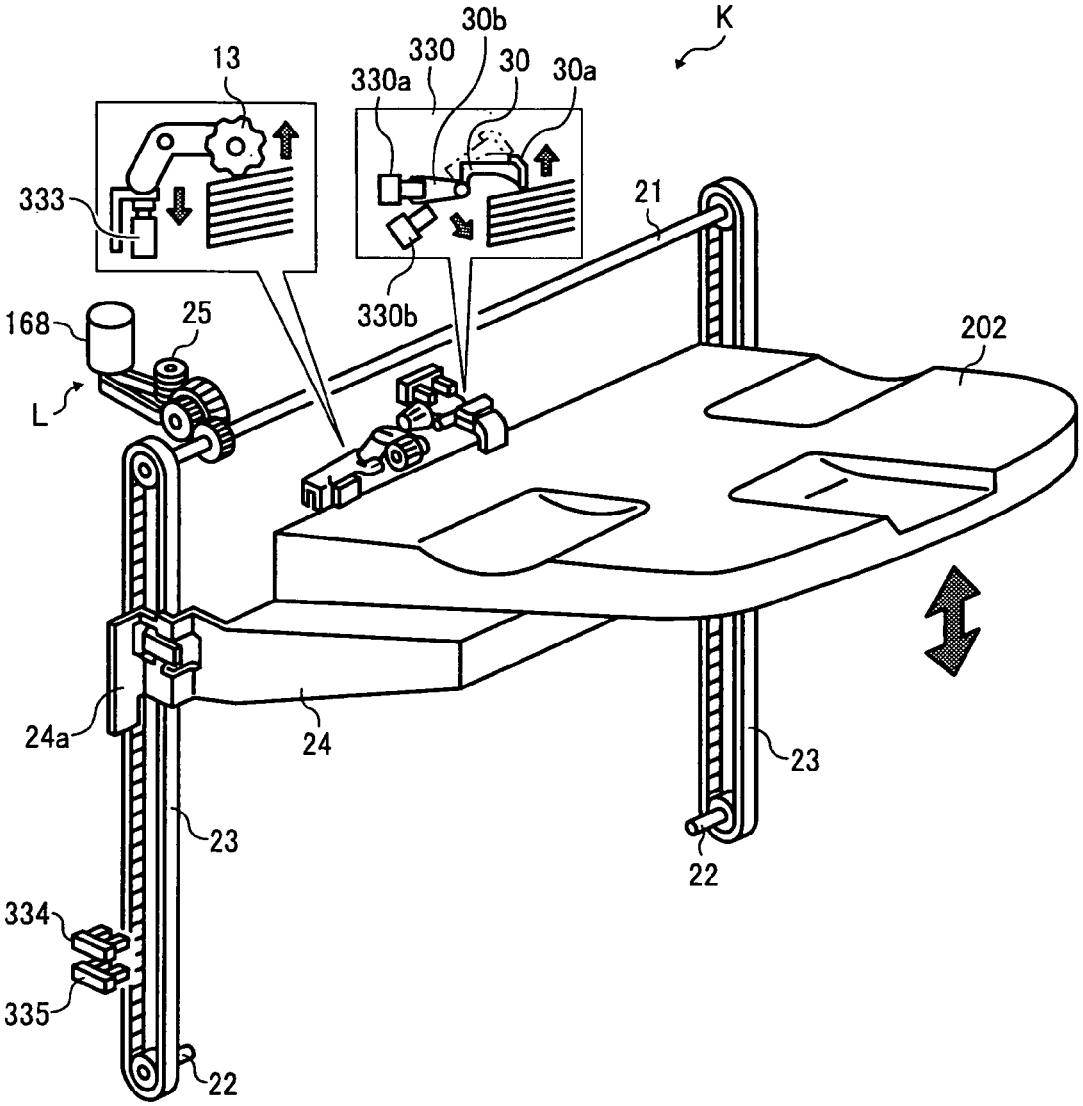
FIG. 3 is an enlarged perspective view of relevant parts of a mechanism that lifts the sheet tray up and down.

A shift-tray sheet discharging unit I that discharges the sheets onto the shift tray 202 includes the shift-tray sheet-discharge rollers 6, a reverse roller 13, a sheet sensor unit 330, the shift tray 202, a shifting mechanism J shown in FIG. 2, and a lifting mechanism K shown in FIG. 3. FIG. 2 is an enlarged perspective view of relevant parts of the shifting mechanism J. FIG. 3 is an enlarged perspective view of relevant parts of the lifting mechanism K.

The reverse roller 13 is made of sponge. When the sheet is discharged by the shift-tray sheet-discharge rollers 6, the reverse roller 13 comes in contact with the sheet so that the trailing end of the sheet abuts against an end fence 32 shown in FIG. 2, which causes the sheets stacked on the shift tray 202 to be aligned. The reverse roller 13 rotates by the rotation of the shift-tray sheet-discharge rollers 6. A lift-up stop switch 333 is provided near the reverse roller 13. When the shift tray 202 lifts up and pushes the reverse roller 13 up, the lift-up stop switch 333 turns ON and a tray lifting motor 168 stops. Thus, the shift tray 202 cannot move up beyond a predetermined position. As shown in FIG. 1, the sheet sensor unit 330 is arranged near the reverse roller 13. The sheet sensor unit 330 detects a position of the top sheet of the sheets or a sheet set SH stacked on the shift tray 202.

As shown in FIG. 3, the sheet sensor unit 330 includes a sheet detection lever 30, a stapled sheet sensor 330*a*, and a non-stapled sheet sensor 330*b*. The sheet detection lever 30 is rotatable around a shaft. The sheet detection lever 30 includes a contact member 30*a* that touches the back end of the top-most sheet stacked on the shift tray 202, and a fan-shaped shielding member 30*b*. The stapled sheet sensor 330*a* is used for sheet discharge control for stapled sheets. The non-stapled sheet sensor 330*b* located lower than the stapled sheet sensor 330*a* is used for sorting.

The stapled sheet sensor 330*a* is turned ON when the stapled sheet sensor 330*a* is behind the shielding member 30*b*. The non-stapled sheet sensor 330*b* is turned ON when the non-stapled sheet sensor 330*b* is behind the shielding member 30*b*. Therefore, when the shift tray 202 lifts up and the sheet detection lever 30 rotates upward together with lifting up of the contact member 30*a*, the stapled sheet sensor 330*a* is turned OFF. When the sheet detection lever 30 rotates upward further, the non-stapled sheet sensor 330*b* is turned ON. When it is determined using the stapled sheet sensor 330*a* and the non-stapled sheet sensor 330*b* that the position of the top sheet reaches a predetermined height, the shift tray 202 moves down by a predetermined amount by the action of the tray lifting motor 168 so that the position of the top sheet is always at the same level.

The lifting mechanism K of the shift tray 202 is described in detail below.

As shown in FIG. 3, the shift tray 202 lifts up and down by the rotation of a driving shaft 21 by a driving unit L. A timing belt 23 is supported by the driving shaft 21 and a driven shaft 22 via a timing pulley (not shown). A side plate 24 that supports the shift tray 202 is fixed to the timing belt 23. With this configuration, a lifting unit including the shift tray 202 moves up and down by rotation of the timing belt 23.

The driving unit L includes the tray lifting motor 168 as a driving source and a worm gear 25. The tray lifting motor 168 can generate both a positive driving force and a negative driving force. The driving force generated by the tray lifting motor 168 is transmitted via the worm gear 25 to the last one of a series of gears attached to the driving shaft 21. Thus, the shift tray 202 is lifted up and down by the tray lifting motor 168. Because the driving-force transmission system receives the driving force from the worm gear 25, the shift tray 202 can keep a certain position. The gear configuration is effective in preventing a sudden drop of the shift tray 202.

The side plate 24 of the shift tray 202 and a shielding plate 24*a* are formed as a unit. A maximum stack-capacity sensor 334 that detects a state where the sheets on the shift tray 202 is at the maximum stack capacity and a lower limit sensor 335 that detects a state where the shift tray 202 is at the lower limit are arranged under the shift tray 202. The maximum stack-capacity sensor 334 and the lower limit sensor 335 turn ON/OFF by the position of the shielding plate 24*a*. The maximum stack-capacity sensor 334 and the lower limit sensor 335 are, for example, photosensors. The maximum stack-capacity sensor 334 turns ON when the maximum stack-capacity sensor 334 is behind the shielding plate 24*a*. The lower limit sensor 335 turns ON when the lower limit sensor 335 is behind the shielding plate 24*a*. The shift-tray sheet-discharge rollers 6 are not shown in FIG. 3.

As shown in FIG. 2, the shifting mechanism J of the shift tray 202 includes a shift motor 169 as a driving source and a shift cam 31. The shift tray 202 moves back and forth in a direction perpendicular to the sheet discharging direction by rotation of the shift cam 31 that is driven by the shift motor 169. A pin 31*a* is attached to a point of the shift cam 31 deviated by a certain distance from the rotational center of the shift cam 31. An end of the pin 31*a* that is not attached to the shift cam 31 is fit movably within a long hole 32*b* of an engagement member 32*a* of the end fence 32. The engagement member 32*a* is fixed to a back surface (surface opposite to the shift tray 202) of the end fence 32. The end fence 32 moves back and forth in the direction perpendicular to the sheet discharging direction by the movement of the pin 31*a* of the shift cam 31. The shift tray 202 moves back and forth in the direction perpendicular to the sheet discharging direction by the movement of the end fence 32. The shift tray 202 stops at two stop positions (corresponding to enlarged views of the shift cam 31 in FIG. 2), one being near a front side of the sheet finisher PD, and the other being near a back side. The shift motor 169 is turned ON/OFF based on a detection signal representing a result of detection of a cut portion of the shift cam 31 by a shift sensor 336. Thus, the shift tray 202 can properly stop at the stop positions.

The front surface of the end fence 32 is provided with a protrusion 32*c* that guides the shift tray 202. The back end of the shift tray 202 is engaged with the protrusion 32*c* movable up and down. With this configuration, the shift tray 202 is supported by the end fence 32 movable in both the vertical direction and the direction perpendicular to the sheet conveying direction. The end fence 32 aligns the trailing ends of the sheets stacked on the shift tray 202.

Figure 4:
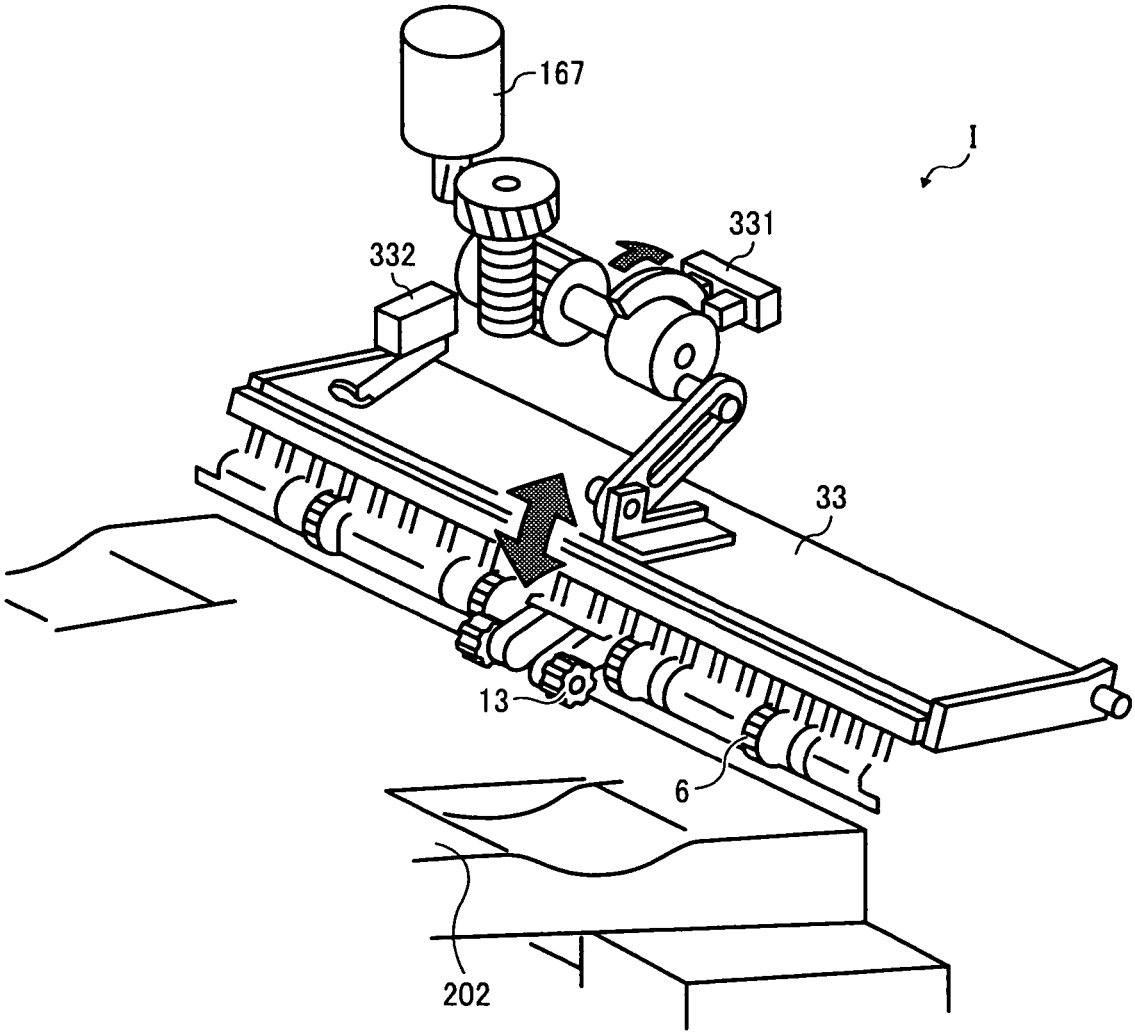
FIG. 4 is a perspective view of a discharging unit that discharges a sheet onto the shift tray.

FIG. 4 is a perspective view of the shift-tray sheet discharging unit I that discharges the sheets onto the shift tray 202.

As shown in FIGS. 1 and 4, the shift-tray sheet-discharge rollers 6 are formed with a driving roller 6*a* and a driven roller 6*b*. An upstream side of the driven roller 6*b* is rotatably attached to a free end of an open/close guiding plate 33. The open/close guiding plate 33 is attached to the sheet finisher PD rotatably around the other end, arranged with the free end being closer to the shift tray 202. The driven roller 6*b* comes in contact with the driving roller 6*a* under the weight of the driven roller 6*b* or by a biasing force, and the sheet is discharged through between the driving roller 6*a* and the driven roller 6*b*. If the sheet set SH to be discharged is stapled, the open/close guiding plate 33 moves up to a predetermined position, and then moves down at predetermined timing decided based on a detection signal from a shift-tray sheet-discharge sensor 303. The predetermined position is decided based on a detection signal from a guiding-plate open/close sensor 331. The open/close guiding plate 33 moves up and down, driven by a guiding-plate open/close motor 167 that is driven by the ON/OFF of a guiding-plate open/close limit switch 332.

The side-stitch tray F for stapling is described in detail below.

Figure 5:
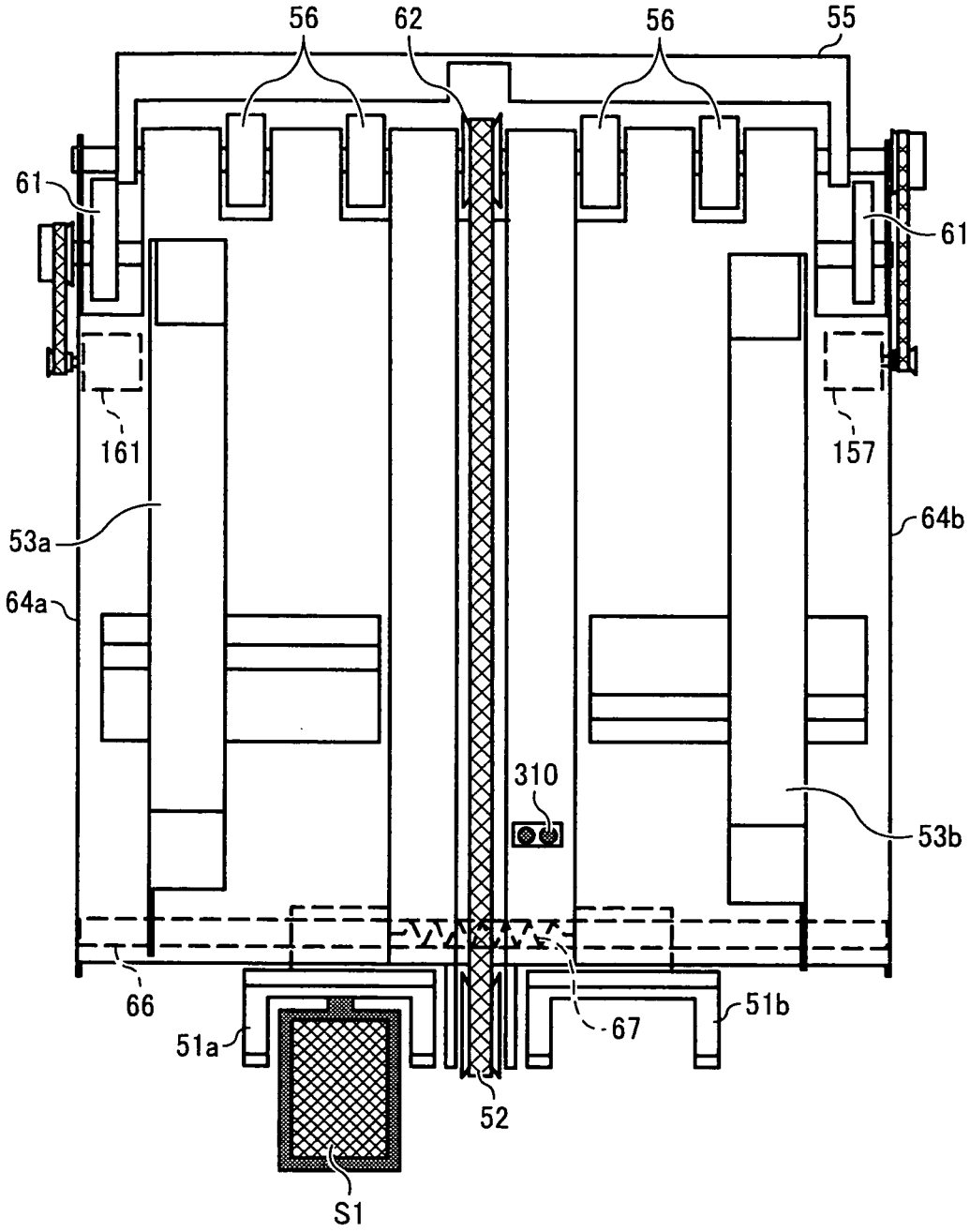
FIG. 5 is a top view of a side-stitch tray shown in FIG. 1, viewed in a direction perpendicular to a sheet conveying surface of the side-stitch tray.
Figure 6:
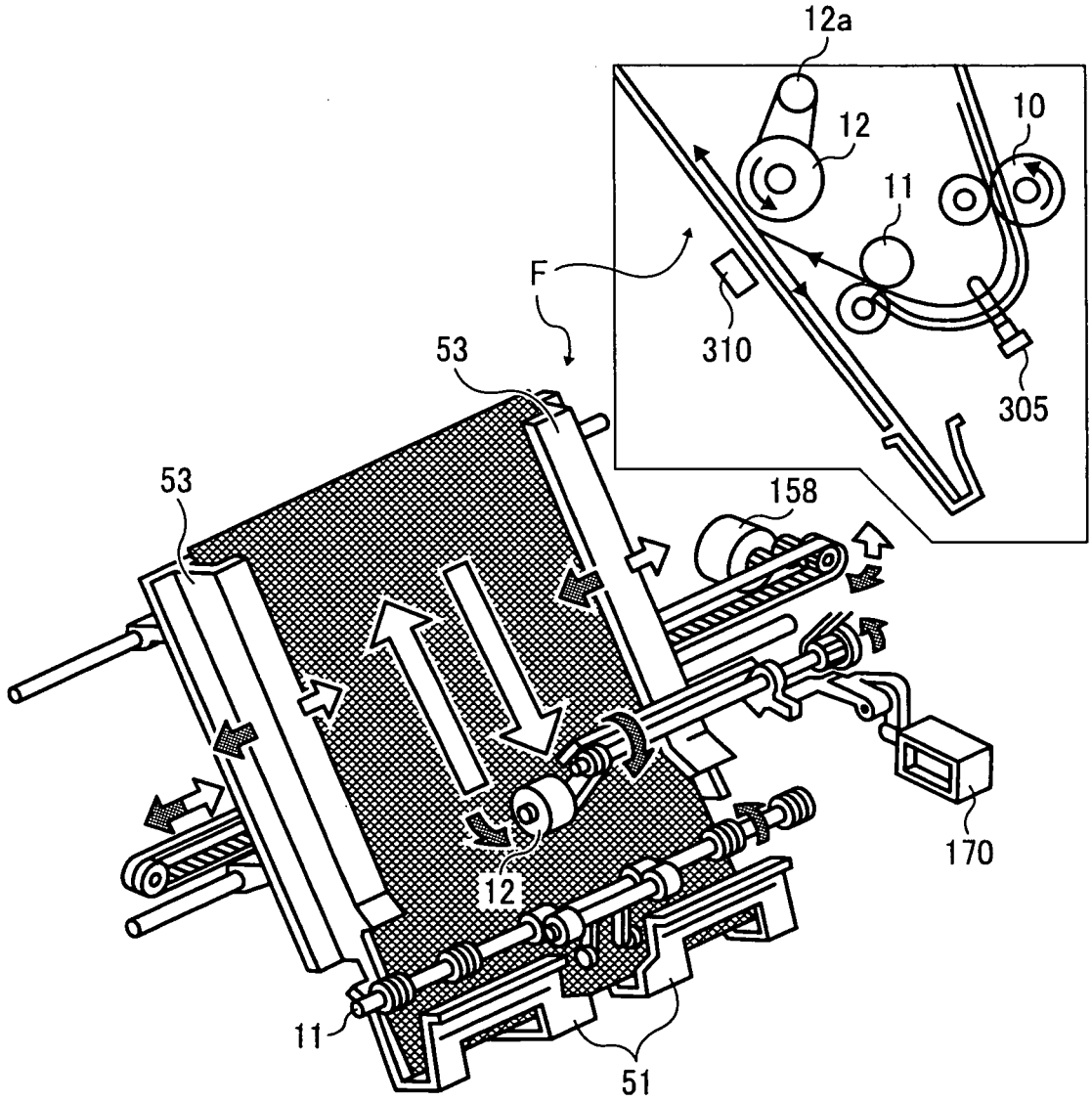
FIG. 6 is a perspective view of the side-stitch tray and a driving mechanism that drives the side-stitch tray.
Figure 7:
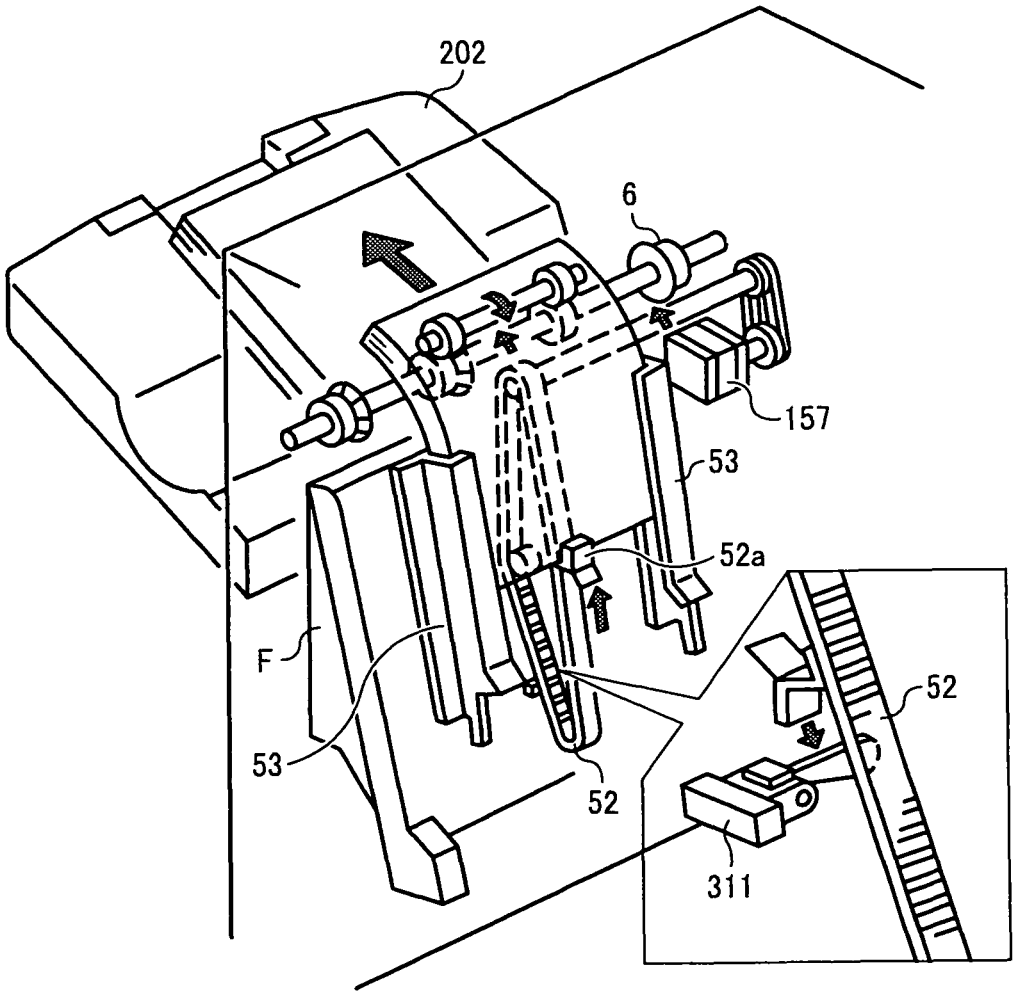
FIG. 7 is a perspective view of a mechanism that lifts a sheet set out of the side-stitch tray.

FIG. 5 is a top view of the side-stitch tray F, viewed in a direction perpendicular to a sheet conveying surface of the side-stitch tray F. FIG. 6 is a perspective view of the side-stitch tray F and a driving mechanism that drives the side-stitch tray F. FIG. 7 is a perspective view of a lifting mechanism that lifts the sheet set out of the side-stitch tray F. As shown in FIG. 6, the sheet that is conveyed to the side-stitch tray F by the side-stitch-tray entrance rollers 11, and is stacked on the side-stitch tray F one by one. A tapping roller 12 aligns the sheets in the sheet length direction (the sheet conveying direction) one sheet by another sheet. The jogger fences 53 align the sheets in the sheet width direction (direction perpendicular to the sheet conveying direction). Within a period between when the side-stitch tray F receives the last sheet of the sheet set SH and when the side-stitch tray F receives the first sheet of a next sheet set SH, the side-stitch stapler S1, which is driven by a staple signal from a control device 350 (see FIG. 15), staples the stacked sheet set SH. The stapled sheet set SH is lifted up to the shift-tray sheet-discharge rollers 6 conveyed by a lifting belt 52 attached with a lifting claw 52*a*. The stapled sheet set SH is then discharged to the shift tray 202 that is in position to receive the sheet set SH.

As shown in FIG. 7, a home position (HP) of the lifting claw 52*a* is detected with a lifting-belt HP sensor 311. The lifting-belt HP sensor 311 turns ON/OFF by operation of the lifting claw 52*a* attached to the lifting belt 52. Two lifting claws 52*a* and 52*a*' are attached to an outer surface of the lifting belt 52, with the lifting claws 52*a* and 52*a*' being opposed to each other. The two lifting claws 52*a* and 52*a*' alternately lift the sheet set SH out of the side-stitch tray F. The lifting belt 52 can be rotated reversely if required. For example, before the lifting claw 52*a* lifts up the sheet set SH, the lifting belt 52 is rotated reversely to align the leading end of the sheet set SH by using a back surface of the lifting claw 52*a*'. The lifting claws 52*a* and 52*a*' are useful to align the sheet length of the sheet set SH.

As shown in FIG. 5, the lifting belt 52 is supported by a driving shaft that is driven by a lifting motor 157 via a driving pulley 62. The driving pulley 62 is located at the center of the width of the aligned sheets. A plurality lifting rollers 56 is fixed to the driving shaft arranged symmetrically with respect to the driving pulley 62. The lifting belt 52 is supported by the driving pulley 62 and a driven pulley. A circumferential speed of the lifting rollers 56 is set faster than a circumferential speed of the lifting belt 52.

As shown in FIG. 6, the tapping roller 12 swings around a fulcrum 12*a* by a tapping solenoid (SOL) 170, which causes the trailing end of the sheets stacked on the side-stitch tray F to abut against a pair of backend fences 51. The tapping roller 12 rotates counterclockwise.

The jogger fences 53 (53*a*, 53*b*, see FIG. 5) moves inside and outside in the sheet width direction by positive rotation or negative rotation of a timing belt driven by a jogger motor 158.

Figure 8:
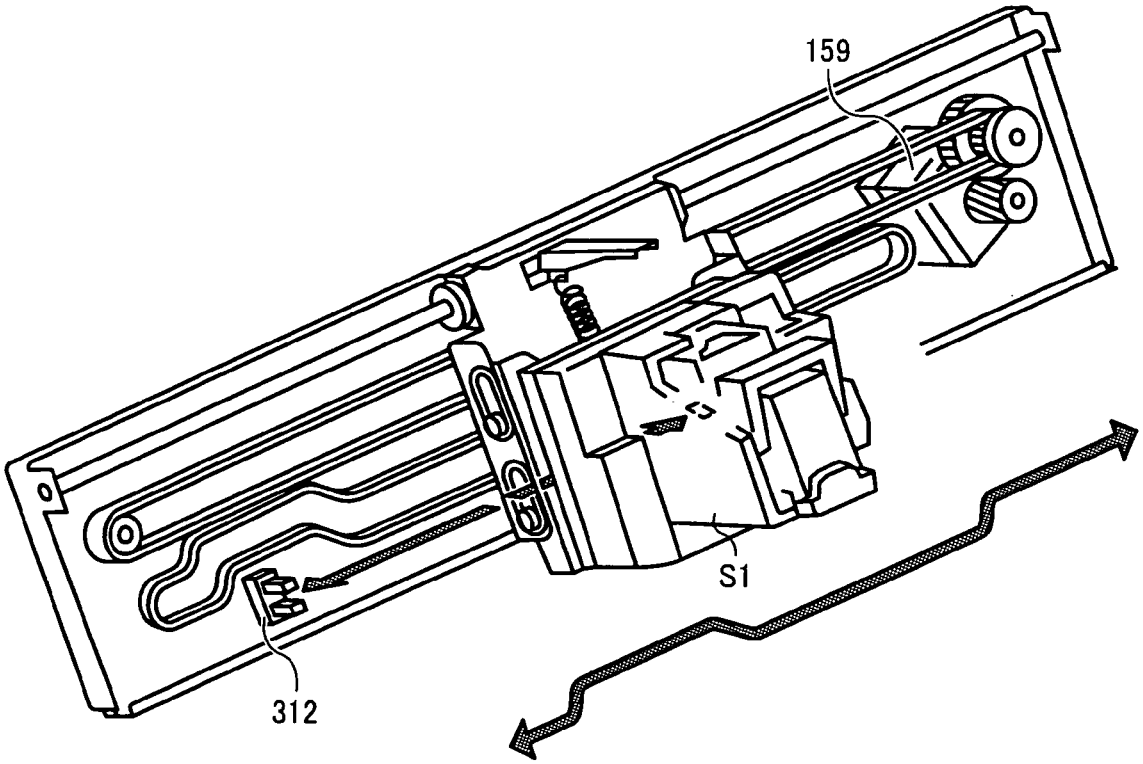
FIG. 8 is a perspective view of a side-stitch stapler shown in FIG. 1 and a driving mechanism that drives the side-stitch stapler.
Figure 9:
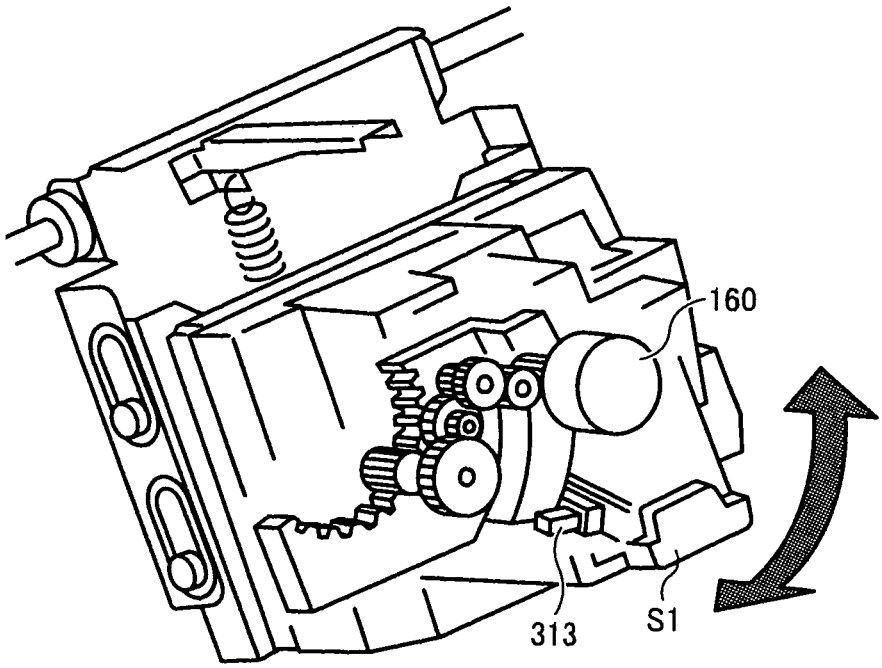
FIG. 9 is a perspective view of a mechanism that rotates the side-stitch stapler shown in FIG. 8 to a slant position.

As shown in FIG. 8, the side-stitch stapler S1 is moved to a target staple position on the sheet side in the sheet width direction by positive rotation or negative rotation of a timing belt driven by a stapler moving motor 159. A stapler HP sensor 312 is arranged at an end of a range of motion of the side-stitch stapler S1 to detect the HP of the side-stitch stapler S1. The movement of the side-stitch stapler S1 is controlled by a distance from the HP. It is clear from the configuration shown in FIG. 9 that the side-stitch stapler S1 can staple the sheet set SH with a staple parallel to the sheet side or a staple slant to the sheet side. Moreover, it is possible to rotate only a stapler unit, separated from the other components of the side-stitch stapler S1, by a predetermined angle for easy loading of the side-stitch stapler S1 with new staples. The side-stitch stapler S1 is rotated by a stapler rotating motor 160. When it is determined by using a stapler slant HP sensor 313 the side-stitch stapler S1 is at the staple position or the load position, the stapler rotating motor 160 stops. After the slant stapling or the loading, the side-stitch stapler S1 rotates to the parallel angle for the next stapling.

As shown in FIG. 5, the components of the side-stitch tray F are arranged between a front-side plate 64*a* and a back-side plate 64*b*. A slide shaft 66 that is a component of the side-stitch tray F is attached with the pair of the backend fences 51 (a backend fence 51*a* closer to the front surface of the sheet finisher PD and a backend fence 51*b* closer to the back surface), slidably along the slide shaft 66. A spring 67 is arranged between the backend fence 51*a* and the backend fence 51*b* so that the backend fence 51*a* and the backend fence 51*b* come close to each other, which makes the HP positioning possible. A sheet sensor 310 detects presence of a sheet on the side-stitch tray F. Later-described components such as a junction-point driving motor 161, a cam 61, and the movable guiding member 55 are shown in FIG. 5.

After aligned in the side-stitch tray F, the sheet set SH to be subjected to the saddle stitch is conveyed to the side-stitch tray F. The sheet set SH is half folded in the side-stitch tray F. In the present embodiment, a sheet-conveying-direction changing mechanism is arranged most-downstream within the side-stitch tray F. The sheet-conveying-direction changing mechanism conveys the sheet set SH to the saddle-stitch tray G.

Figure 10:
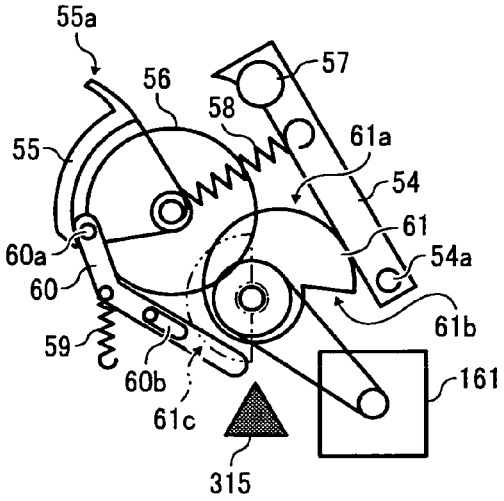
FIG. 10 is a schematic diagram for explaining operation of a sheet-conveying-direction changing mechanism shown in FIG. 1, illustrating a state in which the sheet-conveying-direction changing mechanism is in position to convey the sheet or the sheet set to the shift tray.
Figure 11:
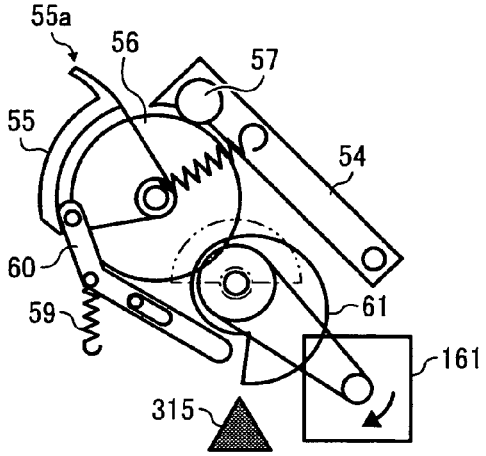
FIG. 11 is a schematic diagram for explaining the operation of the sheet-conveying-direction changing mechanism, illustrating a state in which a junction-point guiding plate rotates toward a lifting roller from the position shown in FIG. 10.
Figure 12:
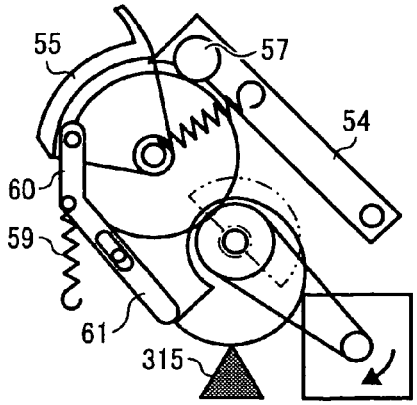
FIG. 12 is a schematic diagram for explaining the operation of the sheet-conveying-direction changing mechanism, illustrating a state in which a movable guiding member rotates toward the junction-point guiding plate from the position shown in FIG. 11, thereby forming a conveyer path connecting to a saddle-stitch tray.
Figure 16:
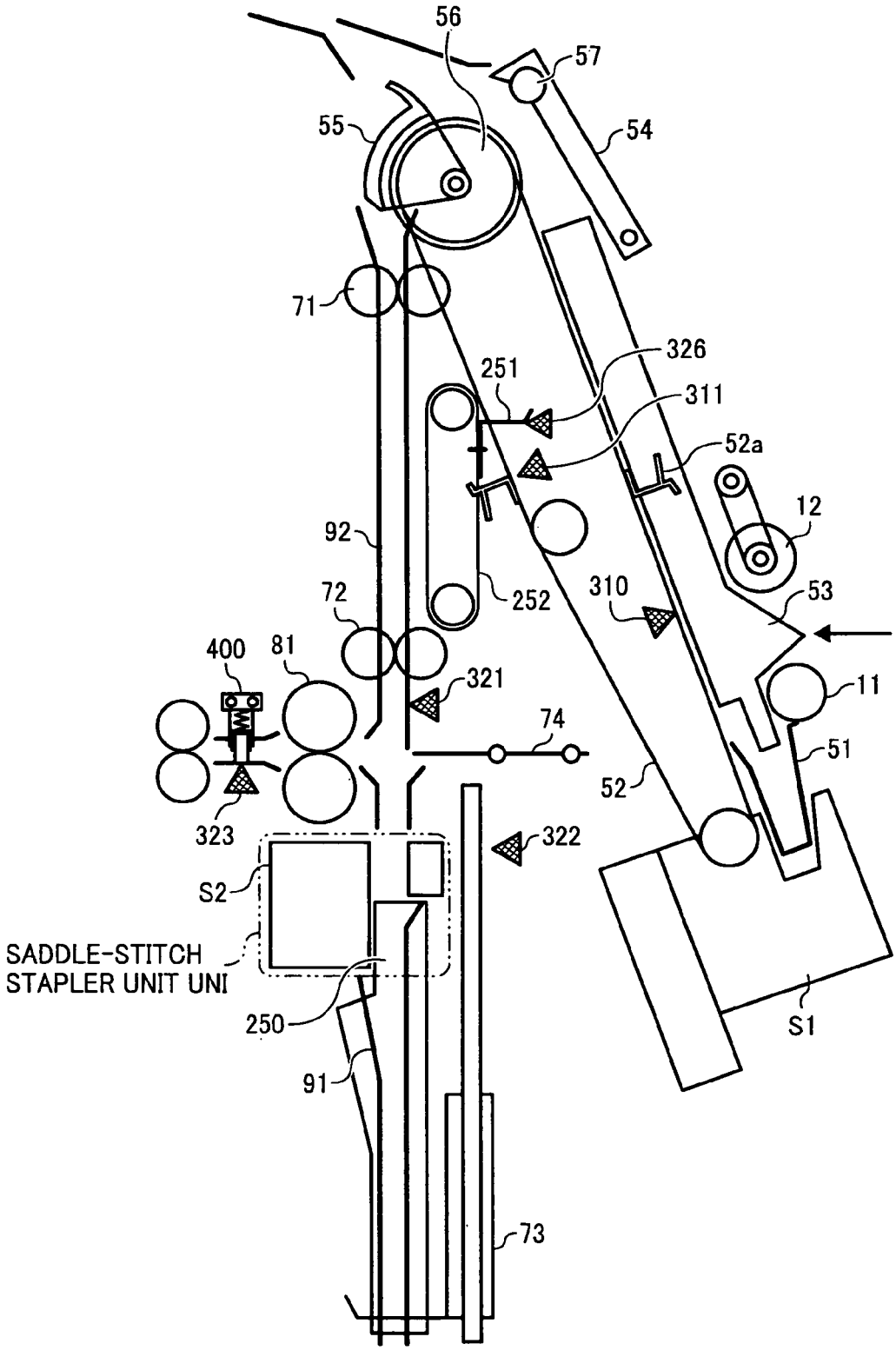
FIG. 16 is an enlarged view of the side-stitch tray and the saddle-stitch tray.

FIG. 16 is an enlarged view of the saddle-stitch tray G shown in FIG. 1. The sheet-conveying-direction changing unit, as shown in FIGS. 1 and 16, includes the junction-point guiding plate 54 and the movable guiding member 55. The junction-point guiding plate 54, as shown in FIGS. 10 to 12, can swing up and down around a fulcrum 54*a*. A pressure roller 57 is attached rotatably to a downstream end of the junction-point guiding plate 54. The pressure roller 57 is pressed against the lifting rollers 56 by a force of a spring 58. The position of the junction-point guiding plate 54 is decided by a contact position of a cam surface 61*a* of the cam 61 that is rotated by the junction-point driving motor 161.

The movable guiding member 55 is supported swingably by a rotating shaft of the lifting rollers 56. A connection member 60*a* rotatably connects a link arm 60 to an end of the movable guiding member 55 that is opposite to the other end closer to the junction-point guiding plate 54. A free end of a shaft the opposite end of which is fixed to the front-side plate 64*a* shown in FIG. 5 is fit movably within a long hole 60*b*. The size of the long hole 60*b* restricts a range of the swing of the link arm 60. The link arm 60 is pressed downward by a spring 59 so that the link arm 60 keeps the position shown in FIG. 10. When a cam surface 61*b* of the cam 61 that is rotated by the junction-point driving motor 161 pushes the link arm 60, the movable guiding member 55, which is connected to the link arm 60, rotates upward.

A junction-point guiding member HP sensor 315 detects a shielding section 61*c* of the cam 61, thereby detecting the HP of the cam 61. The cam 61 is stopped at a target stop position in such a control manner based on a distance from the HP that is measured by counting driving pulses of the junction-point driving motor 161.

FIGS. 10 to 13 are schematic diagrams for explaining the operation of the sheet-conveying-direction changing mechanism. FIG. 10 is a schematic diagram for explaining the positional relation between the junction-point guiding plate 54 and the movable guiding member 55 when the cam 61 is in the HP. A guiding surface 55*a* of the movable guiding member 55 guides the sheet as a part of a conveyer path connecting to the shift-tray sheet-discharge rollers 6.

FIG. 11 is a schematic diagram for explaining a state in which the junction-point guiding plate 54 swings around the fulcrum 54*a* anticlockwise (downward) by the rotation of the cam 61, and thereby the pressure roller 57 presses the lifting rollers 56.

FIG. 12 is a schematic diagram for explaining a state in which the movable guiding member 55 rotates clockwise (upward) by the more rotation of the cam 61, and thereby a conveyer path from the side-stitch tray F to the saddle-stitch tray G is formed with the junction-point guiding plate 54 and the movable guiding member 55. The positional relation among those components in the front-to-back direction is shown in FIG. 5.

In the present embodiment, the junction-point guiding plate 54 and the movable guiding member 55 is driven by the single driving motor. However, it is allowable to drive the junction-point guiding plate 54 and the movable guiding member 55 independently by different motors, and control the moving timing and the stop position properly according to the sheet size and the number of the sheets of the sheet set.

Figure 25:
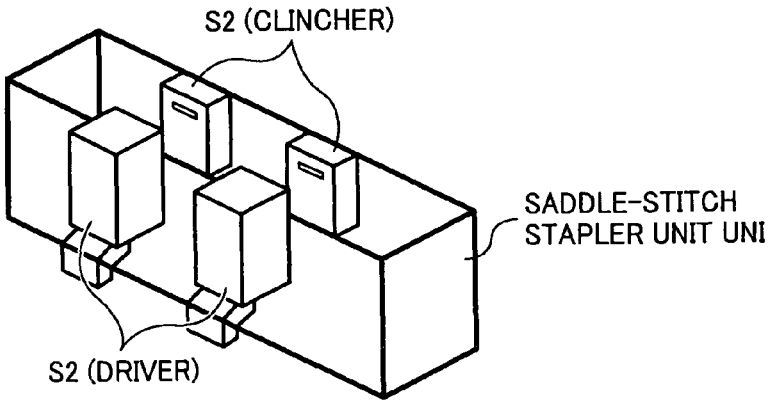
FIG. 25 is a perspective view of a saddle-stitch stapler unit shown in FIG. 1.

As shown in FIG. 1, the saddle-stitch tray G is arranged downstream of the sheet-conveying-direction changing mechanism including the movable guiding member 55 and the lifting rollers 56. The saddle-stitch tray G is arranged almost vertically. A saddle-stitch mechanism is located in the middle of the saddle-stitch tray G, an upper conveyer guiding plate 92 is located in an upper section, and a lower conveyer guiding plate 91 is located in a lower section. A pair of upper conveyer rollers 71 is above the upper conveyer guiding plate 92. A pair of lower conveyer rollers 72 is under the upper conveyer guiding plate 92. A pair of saddle-stitch jogger fences 250 is attached to side faces of the lower conveyer guiding plate 91. The saddle-stitch stapler unit UNI is arranged near the saddle-stitch jogger fences 250. The saddle-stitch jogger fences 250, which is driven by a driving mechanism (not shown), aligns the sheets in the direction perpendicular to the sheet conveying direction (the sheet width direction). The saddle-stitch stapler unit UNI, as shown in FIG. 25, includes two saddle-stitch staplers S2 each including a clincher unit and a driver unit. The saddle-stitch staplers S2 are arranged deviated from each other by a predetermined distance in the sheet width direction. Although the two fixed saddle-stitch staplers S2 are shown in FIG. 25, it is allowable to configure a pair of the clincher unit and the driver unit movable in the sheet width direction and move the clincher unit and the driver unit to the target staple position for two-position stapling.

The upper conveyer rollers 71 and the lower conveyer rollers 72 are formed with a driving roller and a driven roller. A measurement sensor (not shown) is used to measure a nip distance between the upper conveyer rollers 71. The nip distance is measured when the upper conveyer rollers 71 nips the sheet set SH. The value of the nip distance is sent to a central processing unit (CPU) 360. Thus, the control device 350 acquires data about the thickness of the sheet set SH. A later-described pressure release operation can be determined by the CPU 360 from the acquired thickness data.

A movable backend fence 73 is arranged across the lower conveyer guiding plate 91. The movable backend fence 73 is moved in the sheet conveying direction (direction indicated by an arrow P shown in FIG. 24) by a timing belt and a driving mechanism (not shown) that drives the timing belt. The driving mechanism includes a driving pulley, a driven pulley, and a stepper motor that drives the driving pulley. The timing belt is supported by the driving pulley and the driven pulley. A backend tapping claw 251 and a driving mechanism (not shown) that drives the backend tapping claw 251 is arranged an upper end of the upper conveyer guiding plate 92. The backend tapping claw 251 moves by rotation of a timing belt 252 driven by the driving mechanism in the direction away from the sheet-conveying-direction changing mechanism and the direction pushing the trailing end of the sheet set SH (the trailing end when the sheet set SH enters). A tapping-claw HP sensor 326 detects the HP of the backend tapping claw 251.

The saddle-stitch mechanism, which is arranged in the middle of the saddle-stitch tray G, includes the folding plate 74, the folding rollers 81, and the conveyer path H through which the folded sheet set SH passes.

Figure 13:
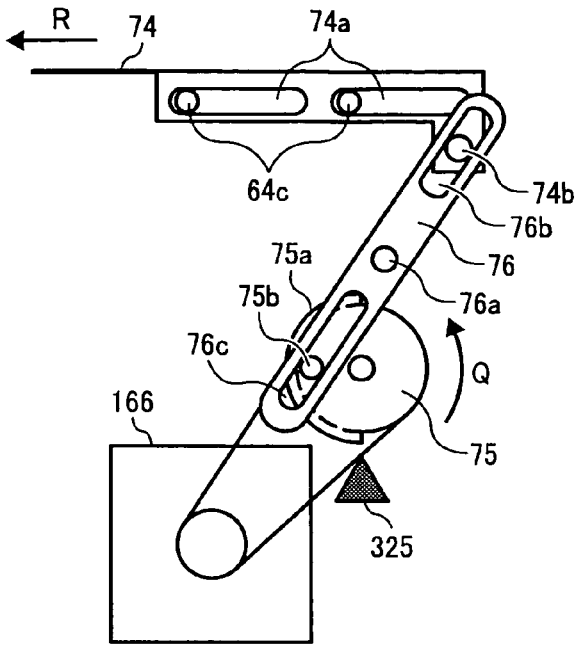
FIG. 13 is a schematic diagram for explaining operation of a moving mechanism that moves a folding plate of the saddle-stitch tray, illustrating a state in which the folding plate starts moving from a HP to fold the sheet set.
Figure 14:
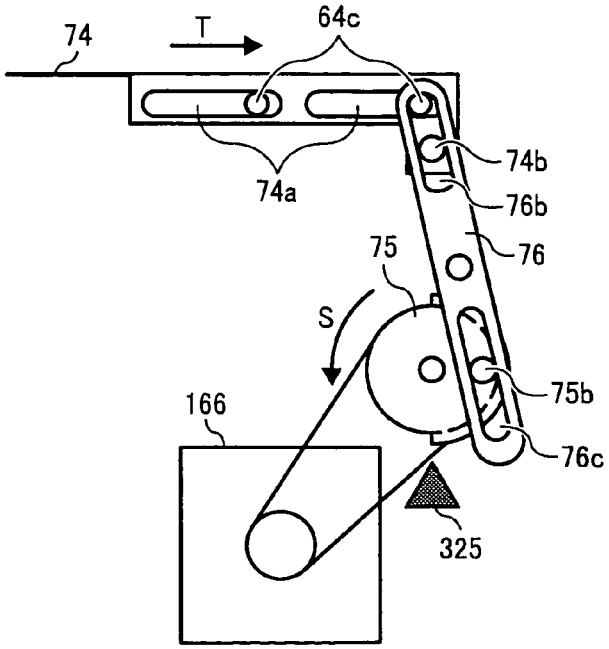
FIG. 14 is a schematic diagram for explaining the operation of the moving mechanism, illustrating a state in which the folding plate is moving back to the HP after folding the sheet set.

FIGS. 13 and 14 are schematic diagrams for explaining the operation of the moving mechanism in which the folding plate 74 half-folds the sheet set.

The folding plate 74 is supported by four shafts 64*c*, two of which extend from the front-side plate 64*a* and the other two of which extend from the back-side plate 64*b*. The four shafts 64*c* are fit movably within four long holes 74*a*, respectively. A shaft 74*b* extending from the folding plate 74 is fit movably within a long hole 76*b* of a link arm 76. With this configuration, the folding plate 74 moves in a direction indicated by an arrow R or T shown in FIGS. 13 and 14 by swing of the link arm 76 around a fulcrum 76*a*.

In other words, a shaft 75*b* of a folding-plate driving cam 75 is fit movably within a long hole 76*c* of the link arm 76. The link arm 76 swings by the rotation of the folding-plate driving cam 75. As shown in FIG. 16, the folding plate 74 moves, by the swing of the link arm 76, back and forth in a direction perpendicular to the lower conveyer guiding plate 91 and the upper conveyer guiding plate 92.

The folding-plate driving cam 75 is rotated by a folding-plate driving motor 166 in a direction indicated by an arrow Q shown in FIG. 13. Whether the folding plate 74 is in the stop position is determined by detecting both ends of a crescentic shielding section 75*a* with a folding-plate HP sensor 325.

FIG. 13 is a schematic diagram of the moving mechanism in which the folding plate 74 is in the HP out of a sheet-set accommodation area of the saddle-stitch tray G. When the folding-plate driving cam 75 is rotated in the direction indicated by the arrow Q, the folding plate 74 is moved in the direction indicated by the arrow R toward the sheet-set accommodation area. FIG. 14 is a schematic diagram of the moving mechanism in which the folding plate 74 inserts the center line of the sheet set to the nip between the folding rollers 81. When the folding-plate driving cam 75 is rotated in a direction indicated by an arrow S, the folding plate 74 is moved in the direction indicated by the arrow T toward the HP.

The sheet set SH can contain a plurality of sheets or can contain a single sheet. When a single sheet is conveyed to the saddle-stitch tray G, the folding plate 74 and the folding rollers 81 immediately folds the single sheet and discharge the folded sheet to the lower tray 203, because it is unnecessary to staple the single sheet. A folding-unit exit sensor 323 detects passage of the half-folded sheet. A saddle-stitch-tray sensor 321 is used to determine whether the sheet set SH is in the saddle-stitch position. A movable-backend-fence HP sensor 322 is used to determine whether the movable backend fence 73 is in the HP. In the present embodiment, a lever 501 is used to measure the height of the half-folded sheets stacked on the lower tray 203. The lever 501 is swingable around a furculum 501*a*. The height is measured from an angle of the lever 501 by using a sheet sensor 505. The lifting operation and the overflow detection of the lower tray 203 are performed based on the measured height.

Figure 26:
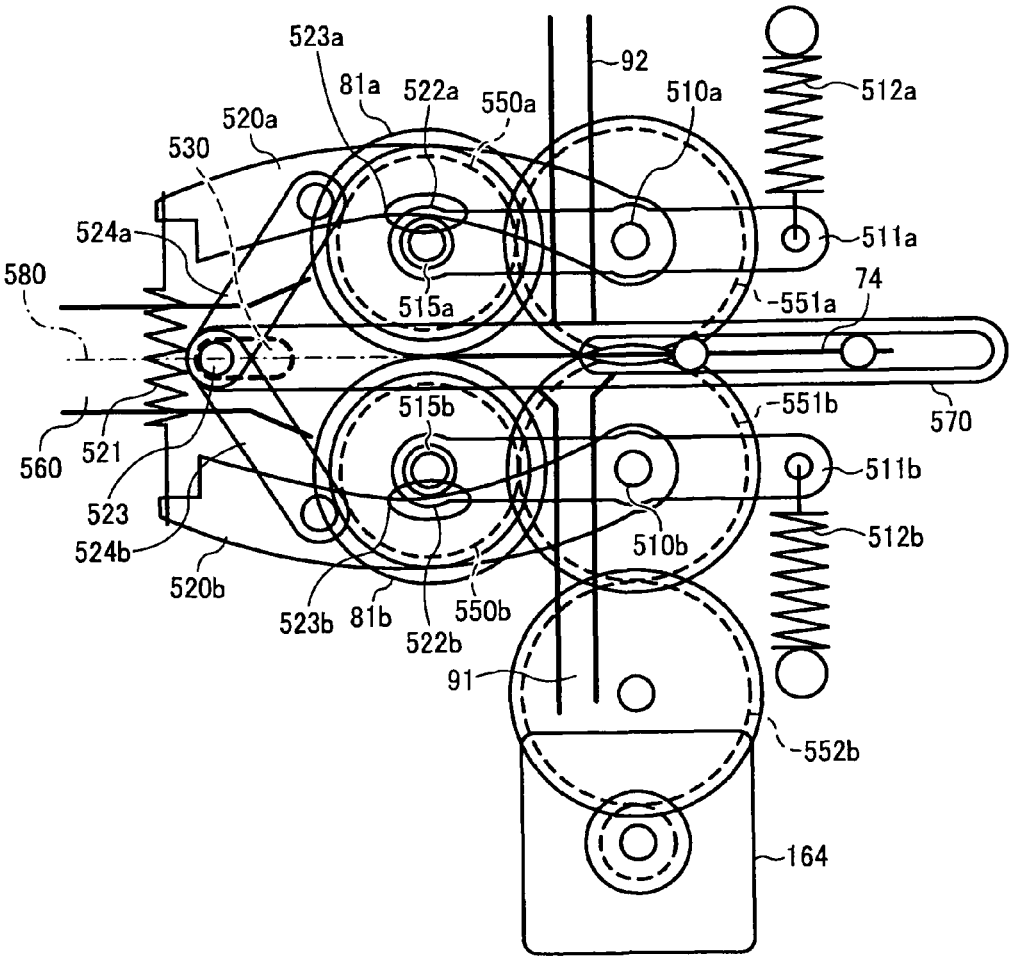
FIG. 26 is a schematic diagram of a pressure/release mechanism that applies or releases pressure to or from the folding rollers.
Figure 27:
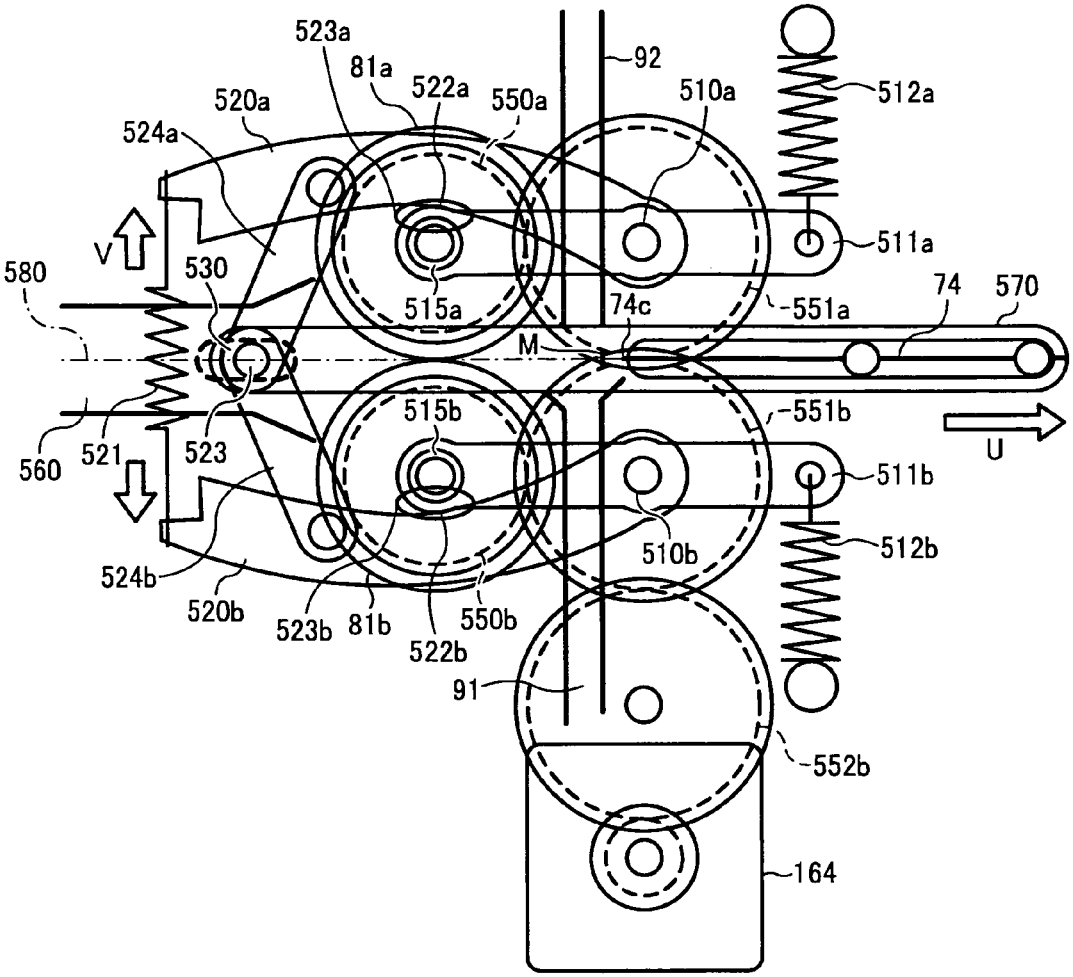
FIG. 27 is a schematic diagram for explaining operation of the pressure/release mechanism for releasing the pressure from the folding rollers.

FIGS. 26 and 27 are schematic diagrams of relevant parts of a pressure/release mechanism that causes the folding rollers 81 to half-fold the sheet set.

The pressure/release mechanism includes the folding rollers 81*a*, 81*b*, swing plates 511*a*, 511*b*, swing arms 520*a*, 520*b*, connection members 524*a*, 524*b*, first pressure springs 512*a*, 512*b*, a second pressure spring 521, the folding plate 74, a pressure-release link 570 as a pressure control member, and a driving motor 164 that drives the folding rollers 81*a*, 81*b*. The folding plate 74 moves, as described with reference to FIGS. 13 and 14, back and forth along a straight line (hereinafter, "trajectory 580"). The nip between the folding rollers 81 (81*a*, 81*b*) is arranged on the trajectory 580. As shown in FIGS. 26 and 27, those components are arranged almost symmetrically with respect to the trajectory 580. Components attached with "a" in its reference numerical indicate that the components are arranged above the trajectory 580. Components attached with "b" in its reference numerical indicate that the components are arranged under the trajectory 580.

The swing plates 511*a* and 511*b* are supported via shafts by the front-side plate 64*a* and the back-side plate 64*b* swingably around fulcrums 510*a* and 510*b*. Moreover, the fulcrums 510*a* and 510*b* of the swing plates 511*a* and 511*b* are supported swingably by an end of each of the swing arms 520*a* and 520*b* via bearings 515*a* and 515*b*. Sides of the swing plates 511*a* and 511*b* arranged upstream of the folding rollers 81*a* and 81*b* are applied to a first biasing force generated by the first pressure springs 512*a* and 512*b*. The first biasing force is equivalent to a force required to convey the sheet set SH at the folding rollers 81*a* and 81*b*. The swing plates 511*a*, 511*b*, the fulcrums 510*a*, 510*b*, the swing arms 520*a*, 520*b*, the first pressure springs 512*a*, 512*b*, and the second pressure spring 521 are arranged between the front-side plate 64*a* and the back-side plate 64*b* aligned in the direction perpendicular to the sheet conveying direction. Only parts attached to the front-side plate 64*a* are shown in FIGS. 26 and 27.

The swing plates 511*a* and 511*b*, as described above, are supported swingably by the fulcrums 510*a* and 510*b* that are provided to the front-side plate 64*a* and the back-side plate 64*b*. Moreover, the swing plates 511*a* and 511*b* are pressed by the first biasing force generated by the first pressure springs 512*a* and 512*b* in such a manner that the free ends of the swing plates 511*a* and 511*b* come closer to each other. The folding rollers 81*a* and 81*b* are supported by the swing plates 511*a* and 511*b*, attached to the ends opposite to the free ends, i.e., downstream sides in the sheet conveying direction via the bearings 515*a* and 515*b*.

The swing arms 520*a* and 520*b* are supported swingably around upstream ends in the same manner as the swing plates 511*a* and 511*b* are supported swingably around the fulcrums 510*a* and 510*b*. The second pressure spring 521 connects the downstream ends of the swing arms 520*a* and 520*b*. A second biasing force generated by the second pressure spring 521 is applied to the swing arms 520*a* and 520*b* in such a manner that the downstream ends come closer to each other. As shown in FIG. 26, the swing arm 520*a* is above the folding roller 81*a*, and the swing arm 520*b* is under the folding roller 81*b*. When the bearings 515*a* and 515*b* moves apart from each other and thereby a distance between the bearings 515*a* and 515*b* increases to a certain length, the bearings 515*a* and 515*b* comes in contact with inner surfaces of the swing arms 520*a* and 520*b*. In this state, the second biasing force generated by the second pressure spring 521 is applied to the folding rollers 81*a* and 81*b* via the swing arms 520*a* and 520*b*. The folding rollers 81*a* and 81*b* receive the first biasing force generated by the first pressure springs 512*a* and 512*b* while the bearings 515*a* and 515*b* are not in contact with the swing arms 520*a* and 520*b*. The second biasing force generated by the second pressure spring 521 is set stronger than the first biasing force generated by the first pressure springs 512*a* and 512*b*. When the sheet set SH enters the nip between the folding rollers 81*a* and 81*b*, the first biasing force generated by the first pressure springs 512*a* and 512*b* is applied. After that, when the bearings 515*a* and 515*b* of the folding rollers 81*a* and 81*b* come in contact with the swing arms 520*a* and 520*b*, the second biasing force generated by the second pressure spring 521 is applied in addition to the first biasing force. Therefore, plays (gaps 523*a* and 523*b*) between the bearings 515*a* and 515*b* and the swing arms 520*a* and 520*b* measured in the state where the folding rollers 81*a* and 81*b* come in contact with each other are an important factor for smooth introduction of the sheet SH into the nip between the folding rollers 81*a* and 81*b*.

After the folding, the folding rollers 81*a* and 81*b* have to convey the sheet set SH. Therefore, it is necessary to provide the driving motor 164 that drives the folding rollers 81*a* and 81*b* and the driving-force transmission mechanism. The driving-force transmission mechanism includes a series of reduction gears 552, 551*b*, and 551*a* that are merged with gears of the driving motor 164 and a series of gears 551*a* and 551*b* that are merged with coaxial gears 550*a* and 550*b* of the folding rollers 81*a* and 81*b*. Those gears rotate at equal speed to convey the sheet set SH.

The pressure-release link 570 is provided to each of the front-side plate 64*a* and the back-side plate 64*b*. The pressure-release link 570 moves back and forth along the trajectory 580 associated with the movement of the folding plate 74. The pressure-release link 570 releases the pressure from the nip between the folding rollers 81*a* and 81*b* by setting the swing arms 520*a* and 520*b* to a pressure-release position. More particularly, the swing arms 520*a* and 520*b* is connected to a movable shaft 523 that is located downstream in the sheet conveying direction with the connection members 524*a* and 524*b*, and thereby the position of the pressure-release link 570 is associated with the position of the swing arms 520*a* and 520*b*. With this configuration, the timing that the pressure is applied/released to/from the sheet set SH is controlled by adjusting the position of the pressure-release link 570. The range of movement of the movable shaft 523 corresponds to a length of a movable-shaft sliding guide hole 530 in the direction parallel to the trajectory 580. The rage of the movement of the movable shaft 523 decides a maximum nip distance between the folding rollers 81*a* and 81*b*. The half-folded sheet set SH is conveyed through a conveyer path 560. The conveyer path 560 is set to make the trajectory 580 pass through the center of the nip. It is allowable to set the maximum nip distance between the folding rollers 81*a* and 81*b* by using, instead of the movable-shaft sliding guide hole 530, long holes as the joints between the connection members 524*a* and 524*b* and the swing arms 520*a* and 520*b*. In this case, the joints are connected to each other with a single member.

With this configuration, the range of the movement of the movable shaft 523 in the sheet conveying direction, which is set by the length of the movable-shaft sliding guide hole 530, decides the gaps 523*a* and 523*b* between the swing arms 520*a* and 520*b* and the bearings 515*a* and 515*b* that are formed in folding-roller pressing sections 522*a* and 522*b*. The gaps 523*a* and 523*b* prevent transmission of the second biasing force generated by the second pressure spring 521. It is possible to apply the weak biasing force by inserting compression springs in the folding-roller pressing sections 522*a* and 522*b* instead of usage of the first pressure springs 512*a* and 512*b*. A width of the gaps 523*a* and 523*b* depends on a position of a downstream end of the movable-shaft sliding guide hole 530. It means that both the position of the movable-shaft sliding guide hole 530 and the length of the pressure-release link 570 in the moving direction decide the width of the gaps 523*a* and 523*b* and the maximum nip distance between the folding rollers 81*a* and 81*b*.

As described above, the movable shaft 523 is connected to the pressure-release link 570. When the pressure-release link 570 moves in a direction indicated by an arrow U, the swing arms 520*a* and 520*b* swing in directions indicated by arrows V. This makes spaces between the swing arms 520*a* and 520*b* and the bearings 515*a* and 515*b* in the folding-roller pressing sections 522*a* and 522*b*. As a result, the second biasing force generated by the second pressure spring 521 cannot be transmitted to the folding rollers 81*a* and 81*b*. The pressure release timing is set by an instruction received from the CPU 360 of the control device 350. When the sheet set SH enters the nip between the folding rollers 81*a* and 81*b* for folding, the strong pressure force is applied. After the sheet set SH is folded, the applied pressure force is decreased. While the sheet set SH is being re-pressed, no pressure force is applied. In this manner, because a part of the sheet set SH upstream of the folded side is free from the pressure, the sheet is subjected to lesser stress.

Figure 28A:
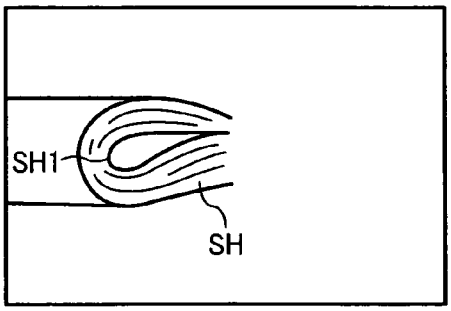
FIGS. 28A and 28B are schematic diagrams of a folded side of the sheet set.
Figure 28B:
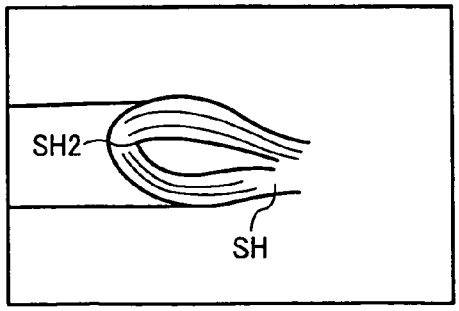

FIG. 28B is a schematic diagram of a crease SH2 when the sheet set SH is folded by the folding rollers 81 shown in FIGS. 26 and 27. The crease SH2 is in a non-deformed state as compared with the crease SH1 shown in FIG. 28A. In the present embodiment, the sheet set SH in the state shown in FIG. 28B is re-pressed.

As shown in FIG. 1, a re-pressing unit 400 that re-presses the sheet set SH is arranged near the conveyer path H that is arranged between the folding rollers 81 and a pair of lower-tray sheet-discharge rollers 83. After the sheet set SH is folded, i.e., the folding plate 74 inserts the sheet set SH into the nip between the folding rollers 81, the re-pressing unit 400 re-presses the sheet set SH, thereby making the crease stronger.

Figure 29:
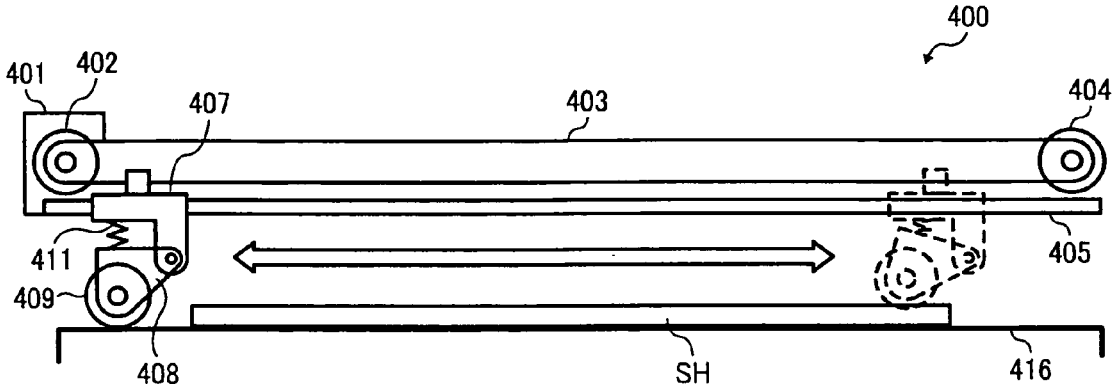
FIG. 29 is a front view of a re-pressing roller and a driving mechanism that drives the re-pressing roller.
Figure 30:
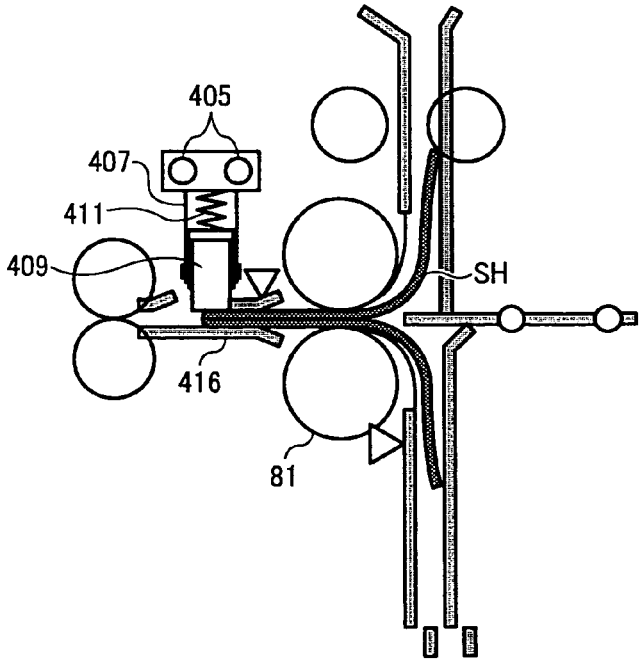
FIG. 30 is a front view for explaining a positional relation between the re-pressing roller and the folding rollers.

FIG. 29 is a front view of the re-pressing unit 400, viewed in the sheet conveying direction. FIG. 30 is a side view of the re-pressing unit 400, viewed from the front side of the sheet finisher PD. The re-pressing unit 400 includes a re-pressing roller 409, a mechanism for supporting the re-pressing roller 409, and a mechanism for driving the re-pressing roller 409. The mechanism for driving the re-pressing roller 409 includes a driving pulley 402, a driven pulley 404, a timing belt 403 that is supported by the driving pulley 402 and the driven pulley 404, and a pulse motor 401 that rotates the timing belt 403. The mechanism for supporting the re-pressing roller 409 includes a movable supporting member 407, a guiding member 405, an upper guiding plate (not shown), and an elastic member 411. The movable supporting member 407 is connected to the timing belt 403, moving along with the timing belt 403. The guiding member 405 guides the movable supporting member 407 so that the movable supporting member 407 moves in a proper moving direction. The upper guiding plate extends to a side of the movable supporting member 407 opposite to a side closer to the re-pressing roller 409. The upper guiding plate decides an angle of the re-pressing roller 409 and prevents bending of the guiding member 405. The elastic member 411, which is shown as a coil spring in FIGS. 29 and 30, presses the movable supporting member 407 toward the sheet set SH (bottom side in FIG. 29). The supporting mechanism is arranged in the direction perpendicular to the sheet conveying direction. The driving mechanism moves the re-pressing roller 409 in the direction in which the supporting mechanism is arranged.

The driving force generated by the pulse motor 401 is transmitted via the timing belt 403 that is supported by the driving pulley 402 and the driven pulley 404 to the movable supporting member 407. The movable supporting member 407 moves by the driving force in the thrust direction, guided by the guiding member 405. The re-pressing roller 409 is arranged between the movable supporting member 407 and a lower guiding plate 416. A friction layer is formed on a circumferential surface of the re-pressing roller 409.

The re-pressing roller 409 is supported rotatably by a re-pressing-roller supporting member 408. The re-pressing-roller supporting member 408 is supported by the movable supporting member 407 swingably in the vertical direction. The re-pressing-roller supporting member 408 is pressed from the movable supporting member 407 by the biasing force generated by the elastic member 411. The re-pressing roller 409 moves in the thrust direction of the guiding member 405 with the movable supporting member 407 in the conditions. During the moving, the biasing force generated by the elastic member 411 toward the lower guiding plate 416 is always applied to the re-pressing roller 409, and the re-pressing roller 409 is movable in the vertical direction. To detect a position of the movable supporting member 407, there are provided two sensors (not shown) aligned in the thrust direction of the guiding member 405. One sensor is arranged near the HP. The other sensor is arranged near an end opposite to the HP.

Figure 15:
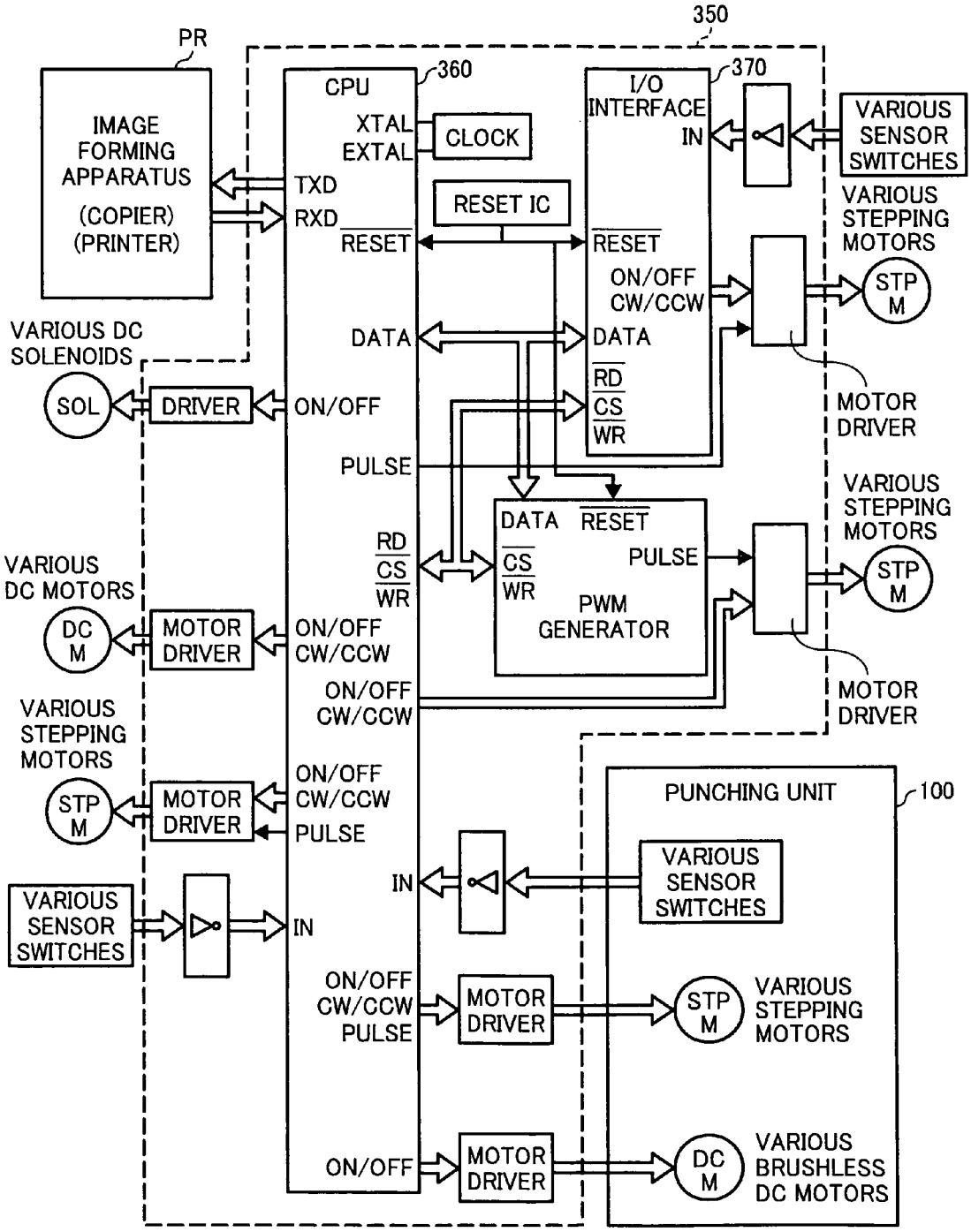
FIG. 15 is a block diagram of control configuration of the sheet finisher shown in FIG. 1.

The control device 350, as shown in FIG. 15, includes a microcomputer including the CPU 360 and an input/output (I/O) interface 370. The CPU 360 receives via the I/O interface 370 signals from various components such as switches on a control panel (not shown) of the image forming apparatus PR, the entrance sensor 301, an upper-tray sheet-discharge sensor 302, the shift-tray sheet-discharge sensor 303, a pre-stack sensor 304, a side-stitch-tray entrance sensor 305, the sheet sensor 310, the lifting-belt HP sensor 311, the stapler HP sensor 312, the stapler slant HP sensor 313, the jogger-fence HP sensor, the junction-point guiding member HP sensor 315, the saddle-stitch-tray sensor 321, the movable-backend-fence HP sensor 322, the folding-unit exit sensor 323, the folding-plate HP sensor 325, the sheet sensor unit 330, the stapled sheet sensor 330*a*, the non-stapled sheet sensor 330*b*, and the guiding-plate open/close sensor 331.

The CPU 360 controls, based on the received signals, various components including the tray lifting motor 168 that lifts up/down the shift tray 202, the guiding-plate open/close motor 167 that opens/closes the open/close guiding plate, the shift motor 169 that shifts the shift tray 202, the motor (not shown) that drives the tapping roller 12, various solenoids including the tapping SOL 170, the motors that drive various conveyer rollers, the motors that drive various sheet-discharge rollers, the lifting motor 157 that drives the lifting belt 52, the stapler moving motor 159 that moves the side-stitch stapler S1, the stapler rotating motor 160 that rotates the side-stitch stapler S1 to the slant position, the jogger motor 158 that moves the jogger fences 53, the junction-point driving motor 161 that swings the junction-point guiding plate 54 and the movable guiding member 55, the motor that drives the conveyer roller for conveying the sheet set coming from the junction point, the motor that moves the movable backend fence 73, the folding-plate driving motor 166 that moves the folding plate 74, and the motor that drives the folding rollers 81. The motor that drives the side-stitch-tray entrance rollers 11 sends a pulse signal to the CPU 360. Upon receiving the pulse signal, the CPU 360 counts the received pulse signal and controls the tapping SOL 170 and the jogger motor 158 based on a result of count.

The motor that drives the folding rollers 81 is, for example, a stepper motor. The motor is controlled directly by the CPU 360 via a motor driver or indirectly by the CPU 360 via the motor driver and the I/O interface 370. The punching unit 100 performs the punching operation by the operation of the clutches and the motors under control of the CPU 360.

The CPU 360 controls the sheet finisher PD by reading a computer program from a read only memory (ROM) (not shown), loading the computer program on a work area of a random access memory (RAM) (not shown), and executing the loaded computer program.

The operation of the sheet finisher PD that is controlled by the CPU 360 is described below.

In the present embodiment, one of the following finisher modes is selected. The sheet is discharged in a manner that is set according to the selected finisher mode.

1. Non-staple mode a: The sheet is conveyed through the conveyer path A and the conveyer path B, and is discharged to the upper tray 201.
2. Non-staple mode b: The sheet is conveyed through the conveyer path A and the conveyer path C, and is discharged to the shift tray 202.
3. Sort and stack mode: The sheets are conveyed through the conveyer path A and the conveyer path C, and are discharged to the shift tray 202. The shift tray 202 sorts the sheets by moving in the direction perpendicular to the sheet discharging direction immediately after the last sheet of each section is discharged.
4. Staple mode: The sheets are conveyed through the conveyer path A and the conveyer path D to the side-stitch tray F. The sheets are aligned and stapled in the side-stitch tray F. The stapled sheet set SH is discharged to the shift tray 202 via the conveyer path C.
5. Saddle-stitch mode: The sheets are conveyed through the conveyer path A and the conveyer path D to the side-stitch tray F. The sheets are aligned in the side-stitch tray F. After that, the aligned sheet set SH is conveyed to the saddle-stitch tray G. The sheet set SH is stapled and half-folded in the saddle-stitch tray G. The folded sheet set SH is discharged to the lower tray 203 via the conveyer path H. The operation in each of the finisher modes is described in detail below.

In the non-staple mode a, after passed through the conveyer path A, the sheet is conveyed to the conveyer path B by the operation of the switching claw 15, and then is discharged to the upper tray 201 by the conveyer rollers 3 and the upper-tray sheet-discharge rollers 4. The state of the discharged sheets is monitored by using the upper-tray sheet-discharge sensor 302 that is arranged near the upper-tray sheet-discharge rollers 4.

In the non-staple mode b, after passed through the conveyer path A, the sheet is conveyed to the conveyer path C by the operation of the switching claws 15 and 16, and then is discharged to the shift tray 202 by a pair of conveyer rollers 5 and the shift-tray sheet-discharge rollers 6. The state of the discharged sheets is monitored by using the shift-tray sheet-discharge sensor 303 that is arranged near the shift-tray sheet-discharge rollers 6.

In the sort and stack mode, the sheets are conveyed and discharged in the same manner in the non-staple mode b. The shift tray 202 sorts the sheets by moving in the direction perpendicular to the sheet discharging direction immediately after the last sheet of each section is discharged.

In the staple mode, after passed through the conveyer path A, the sheets are conveyed to the conveyer path D by the operation of the switching claws 15 and 16, and then conveyed to the side-stitch tray F by the conveyer rollers 7, 9, 10, and the side-stitch-tray entrance rollers 11. The side-stitch tray F receives the sheets from the side-stitch-tray entrance rollers 11 one by one, aligns the received sheets, and staples the set of the sheets with the side-stitch staples S1. After that, the stapled sheet set SH is lifted up with the lifting claw 52*a*, and then discharged to the shift tray 202 by the shift-tray sheet-discharge rollers 6. The state of the discharged sheets is monitored by using the shift-tray sheet-discharge sensor 303 that is arranged near the shift-tray sheet-discharge rollers 6.

When the staple mode is selected, as shown in FIG. 6, the jogger fences 53 are moved from the HP to a stand-by position. The stand-by position is set to a position away by 7 millimeters (mm) from a side of the sheets to be conveyed to the side-stitch tray F. When the sheets are conveyed by the side-stitch-tray entrance rollers 11 and the trailing end of the sheets is passed the side-stitch-tray entrance sensor 305, the jogger fences 53 move by 5 mm inside from the stand-by position, and stop at the position. The side-stitch-tray entrance sensor 305 sends a signal to the CPU 360 when the trailing end passes the side-stitch-tray entrance sensor 305 (see FIG. 33). The CPU 360 counts the number of pulses that are received, after receiving the signal from the side-stitch-tray entrance sensor 305, from a motor (not shown) that drives the side-stitch-tray entrance rollers 11. When the CPU 360 counts up to a predetermined number, the CPU 360 turns the tapping SOL 170 ON. The tapping roller 12 swings according to ON/OFF of the tapping SOL 170. When the tapping SOL 170 is ON, the tapping roller 12 swings downward, thereby tapping the sheets. The sheets come abut on the backend fences 51, and thus the sheets are aligned. The number of the sheets to be conveyed to the side-stitch tray F is counted by using the entrance sensor 301 or the side-stitch-tray entrance sensor 305. The entrance sensor 301 or the side-stitch-tray entrance sensor 305 sends a signal to the CPU 360 each time the sheet passes. The CPU 360 counts the number of the received signals.

When a predetermined time has passed since the tapping SOL 170 is turned OFF, the jogger motor 158 causes the jogger fences 53 to move by 2.6 mm inside, and then stop the jogger fences 53 temporarily for the sheet alignment. After that, the jogger fences 53 move by 7.6 mm outside to the HP to ready for the next sheet. The series of the sheet alignment processes is repeated until all of the sheets of the sheet set SH are aligned. When the sheet set SH is aligned, the jogger fences 53 move by 7 mm inside, and supports the both sides of the sheet set SH for the stapling. When a predetermined time has passed, the side-stitch stapler S1, which is driven by a staple motor (not shown), stapes the sheet set SH. If the sheet set SH is to be stapled at two or more positions, the stapler moving motor 159 moves the side-stitch stapler S1 to the next staple position along the trailing end. Thus, the side-stitch stapler S1 staples all the staple positions.

After the stapling process, the lifting motor 157 rotates the lifting belt 52. At the same time, the sheet-discharge motor rotates the shift-tray sheet-discharge rollers 6 as preparation for receiving the sheet set SH that is to be lifted up with the lifting claw 52*a*. The jogger fences 53 are controlled in various manners depending on the sheet size and the number of the sheets of the sheet set. For example, if the number of the sheets is smaller than a reference number or if the sheet size is smaller than a reference size, the lifting claw 52*a* hooks the trailing end of the sheet set SH that is supported by the jogger fences 53, and lifts the sheet set SH up. When a predetermined time has passed since the sheet sensor 310 or the lifting-belt HP sensor 311 sends a signal, the jogger fences 53 move 2 mm outside and release the sheet set SH. The predetermined time is set to cause the jogger fences 53 to release the sheet set SH at timing within a period between when the lifting claw 52*a* comes in contact with the trailing end of the sheet set SH and when the lifting claw 52*a* passes the front ends of the jogger fences 53. If the number of the sheets is larger than the reference number or if the sheet size is larger than the reference size, the jogger fences 53 move 2 mm outside before the lifting claw 52*a* starts lifting the sheet set SH. In each case, when the sheet set SH is lifted above the jogger fences 53, the jogger fences 53 move by 5 mm outside to the stand-by position to prepare for the next sheet. The supporting force can be adjusted by changing a distance between the jogger fences 53 and the sheet set.

FIG. 16 is a front view of the side-stitch tray F and the saddle-stitch tray G. FIGS. 17 to 24 are schematic diagrams for explaining the operation in the saddle-stitch mode.

Figure 17:
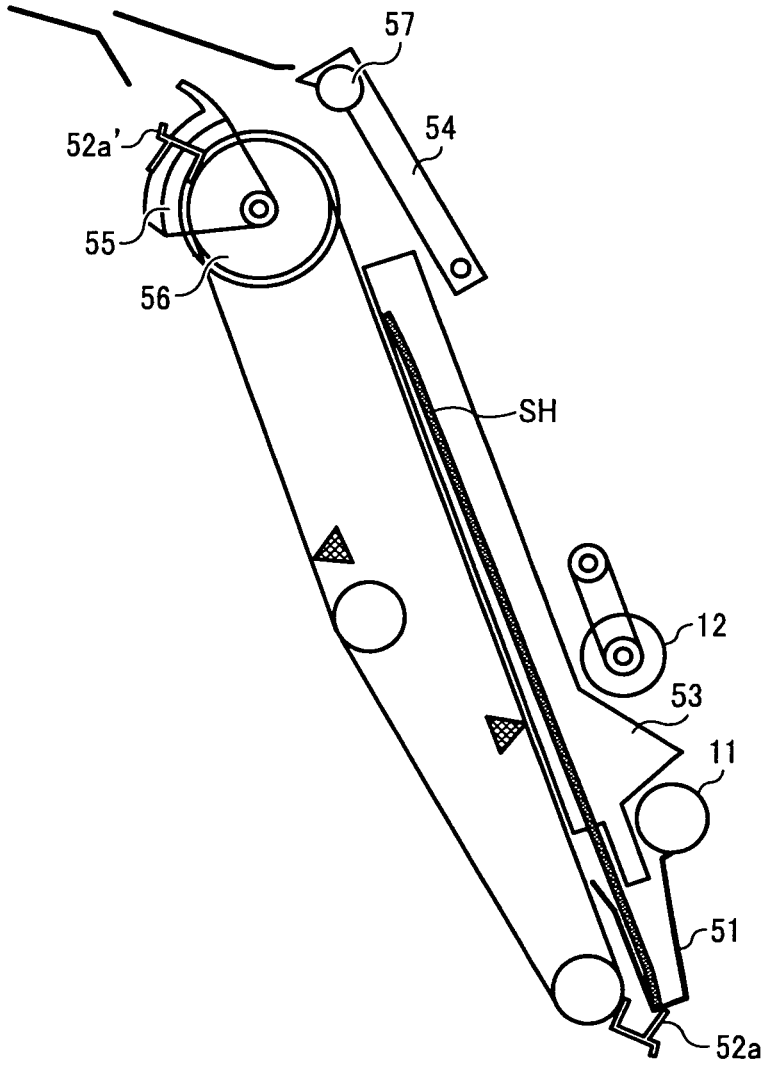
FIG. 17 is a schematic diagram for explaining operation for aligning the sheet set on the side-stitch tray.

After passed through the conveyer path A, the sheets are conveyed to the conveyer path D by the operation of the switching claws 15 and 16, are then conveyed to the side-stitch tray F shown in FIG. 16 by the conveyer rollers 7, 9, 10, and the side-stitch-tray entrance rollers 11. The side-stitch tray F receives the sheets from the side-stitch-tray entrance rollers 11 one by one, and aligns the received sheets in the same manner as in the staple mode. However, in the saddle-stitch mode, the sheet set is not stapled in the side-stitch tray F. Thus, the sheet set is in the conditions as shown in FIG. 17 aligned with the backend fences 51.

Figure 18:
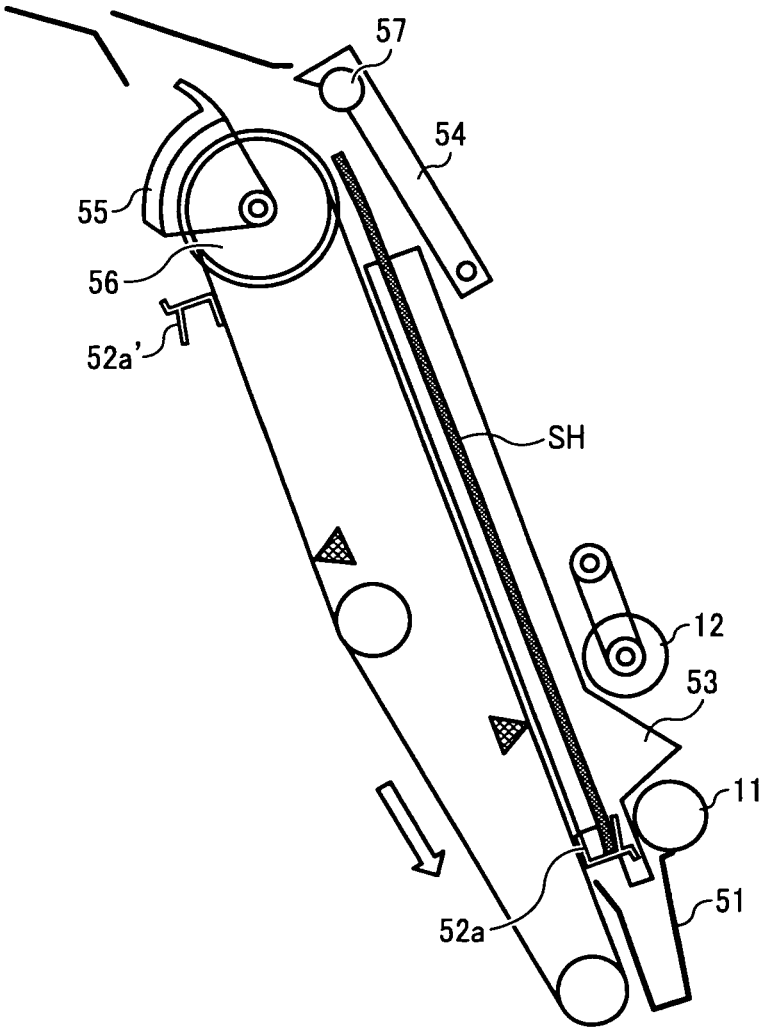
FIGS. 18 and 19 are schematic diagrams for explaining operation for conveying the sheet set from the side-stitch tray to the saddle-stitch tray.
Figure 19:
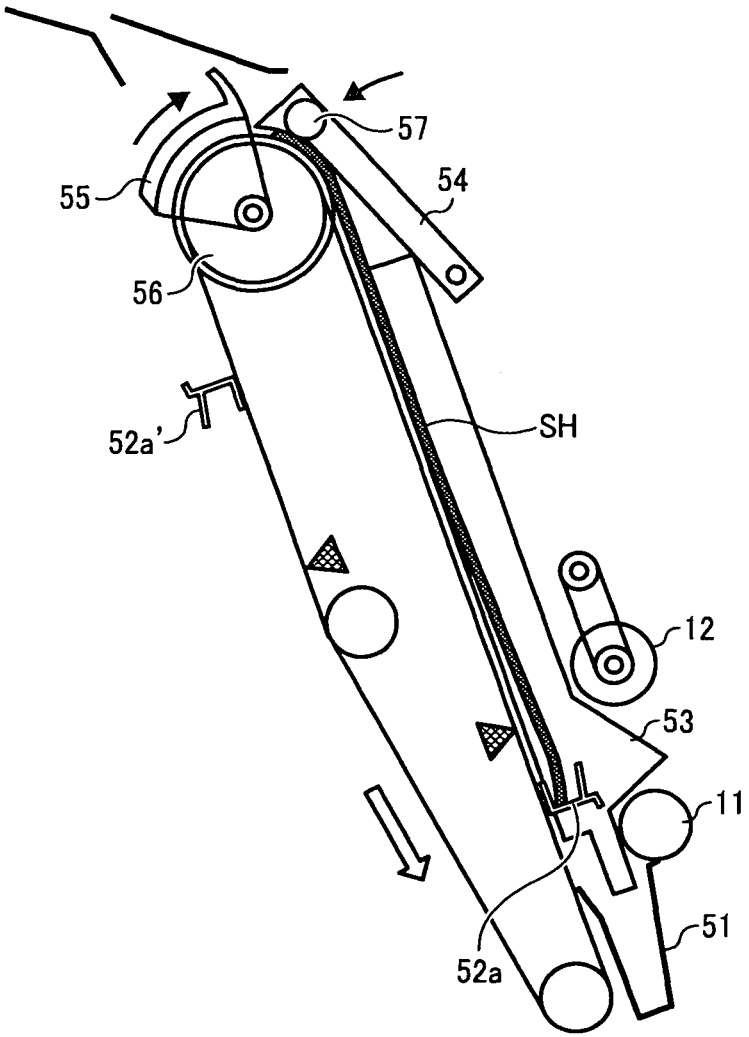

After the sheet set is roughly aligned, the sheet set is lifted up with the lifting claw 52*a* as shown in FIG. 18. The leading end of the sheet set is then nipped with the lifting rollers 56 and the pressure roller 57 as shown in FIG. 19. Subsequently, the junction-point guiding plate 54 and the movable guiding member 55 rotate, thereby forming the conveyer path to the saddle-stitch tray G. The sheet set SH is conveyed to the saddle-stitch tray G by the lifting claw 52*a* and the lifting rollers 56, passed through the formed conveyer path. The lifting rollers 56 that are attached to the driving shaft of the lifting belt 52 are driven in synchronized with the lifting belt 52.

Figure 20:
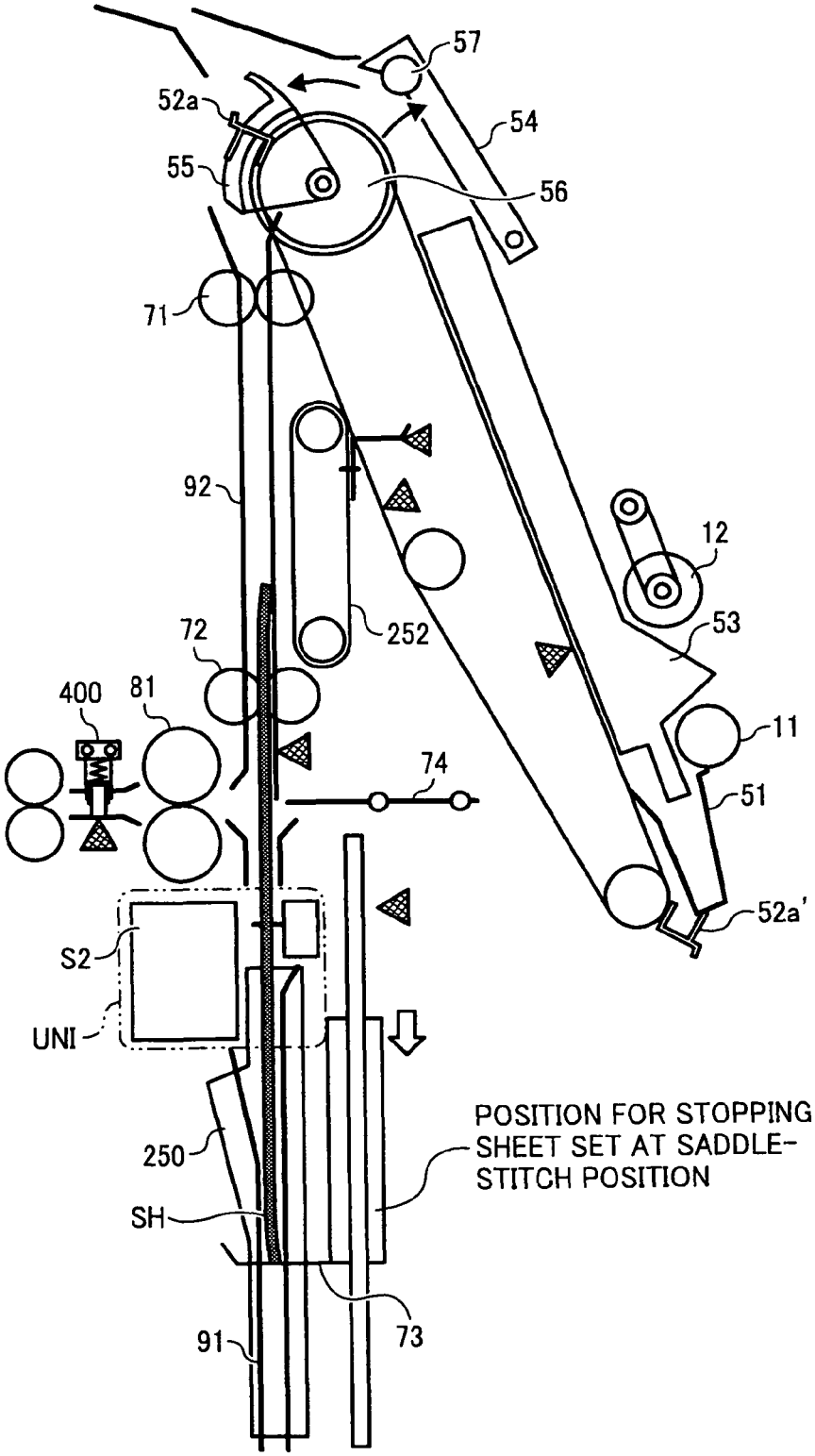
FIG. 20 is a schematic diagram for explaining operation of the saddle-stitch tray for receiving the sheet set from the side-stitch tray.
Figure 21:
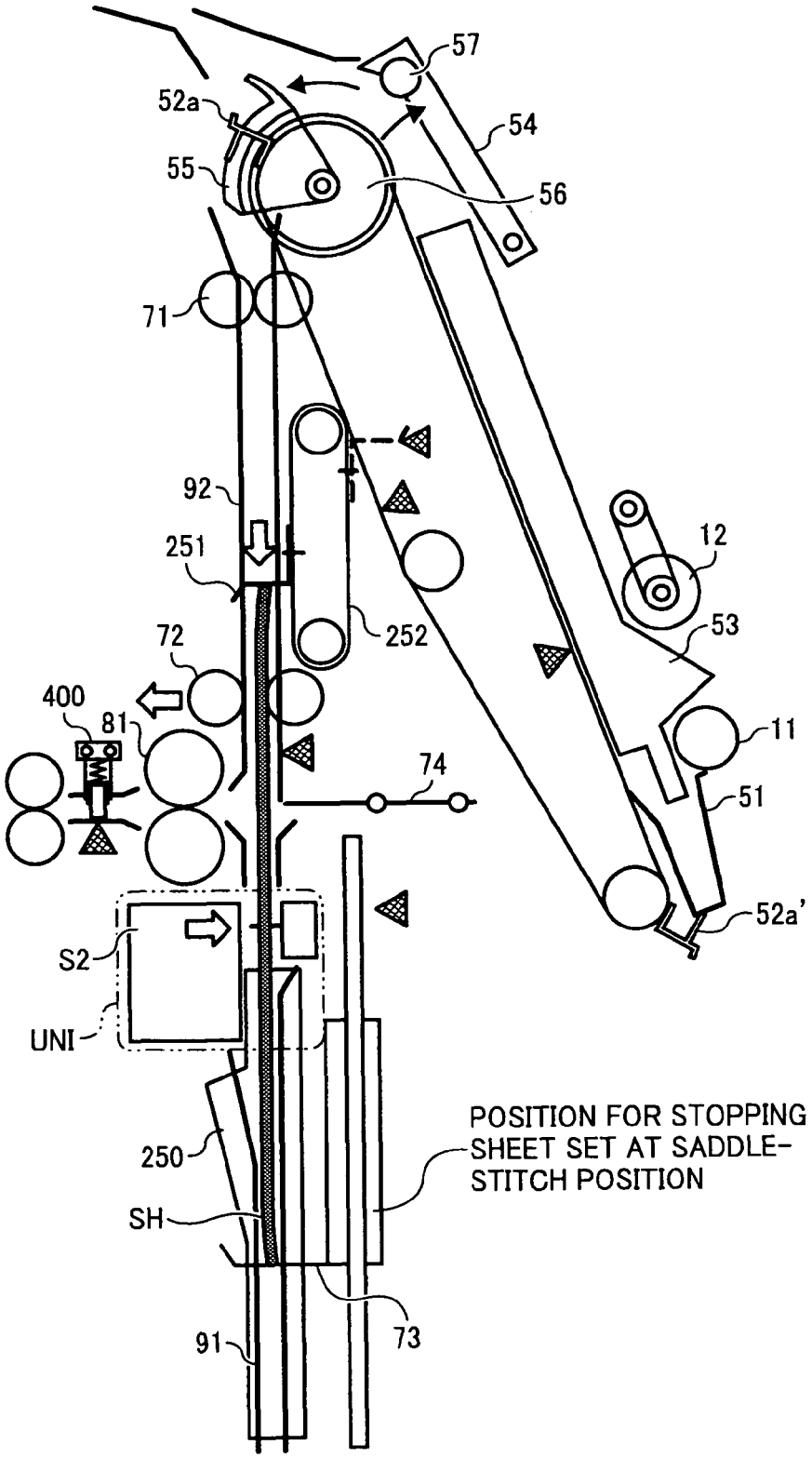
FIG. 21 is a schematic diagram for explaining operation for saddle-stitch stapling the sheet set on the saddle-stitch tray.

The sheet set SH is conveyed to the position with the lifting claw 52*a* where the trailing end has passed through the lifting rollers 56. After that, the sheet set SH is conveyed to the position as shown in FIG. 20 with the upper conveyer rollers 71 and the lower conveyer rollers 72. The stand-by position of the movable backend fence 73 depends on a length of the sheet set SH in the sheet conveying direction, and the movable backend fence 73 is at the stand-by position. When the leading end of the sheet set SH comes in contact with the movable backend fence 73, the lower conveyer rollers 72 apart from each other and the trailing end of the sheet set SH is tapped with the backend tapping claw 251 as shown in FIG. 21. Thus, the top-and-bottom sides of the sheet set SH are finely aligned. On the other hand, the right-and-left sides of the sheet set SH are aligned with the saddle-stitch jogger fences 250 that are arranged under the saddle-stitch stapler unit UNI. In this manner, the right-and-left sides are aligned with the saddle-stitch jogger fences 250, and the top-and-bottom sides of the sheet set SH are aligned with the movable backend fence 73 and the backend tapping claw 251.

The positions of the movable backend fence 73 and the saddle-stitch jogger fences 250 are set depending on the sheet size, the number of the sheets, and the sheet thickness such that the sheet set SH is aligned properly. If the sheet set is thick, a ratio of a space filled with the sheets to a space of the conveyer path increases, as a result of which, the sheets may not be aligned finely with a single alignment operation. Therefore, if the sheet set is thick, the sheets are subjected to twice or more alignment operation for the fine alignment conditions.

The time required to stack the sheets one by one in the side-stitch tray F is proportional to the number of the sheets. In other words, it takes a long time until the next set is conveyed to the sheet finisher PD. Therefore, even if the sheets are subjected to twice or more alignment operation, the time required for the finishing process will not be increased due to the alignment operation. For this reason, the increase in the number of the alignment operation in consideration of the processing time in the side-stitch tray F makes the finishing quality improved.

As shown in FIG. 21, the saddle-stitch stapler S2 staples the center of the aligned sheets. Therefore, the movable backend fence 73 should be at such a position that the center of the sheet set SH is aligned with the saddle-stitch stapler S2.

Figure 22:
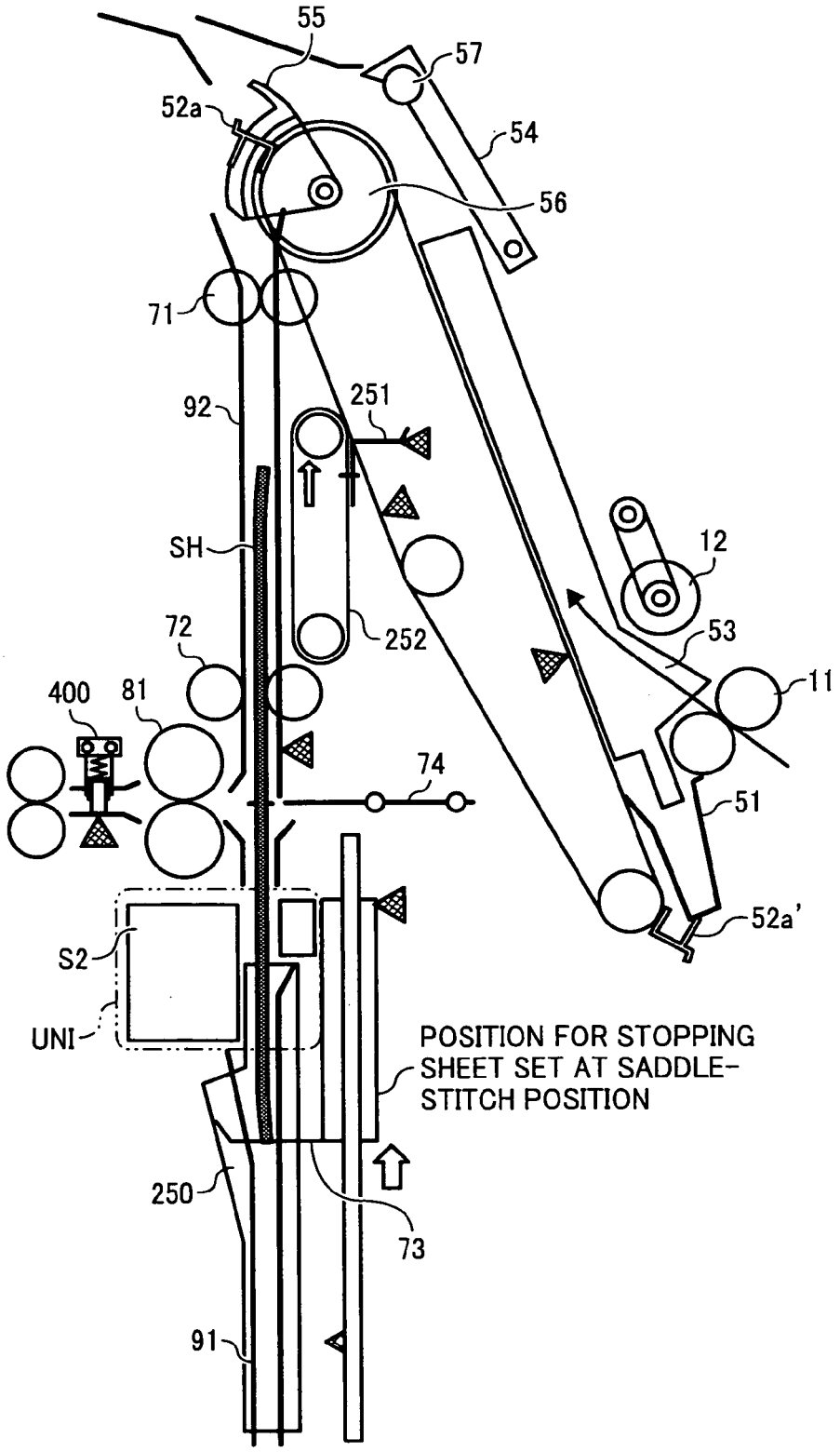
FIG. 22 is a schematic diagram for explaining operation for preparing to fold the sheet set.
Figure 23:
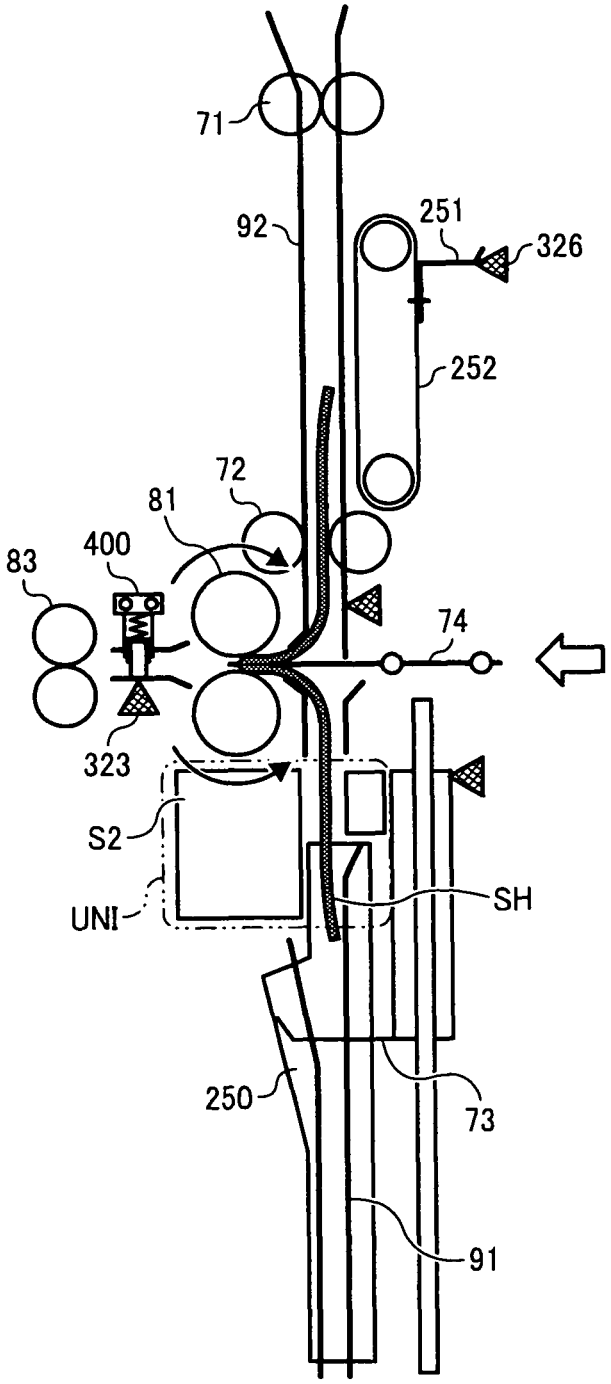
FIG. 23 is a schematic diagram for explaining operation of the folding plate in which the folding plate moves from the position shown in FIG. 22 to insert the sheet set into a nip of a pair of folding rollers.

It is noted that the position of the movable backend fence 73 is decided based on a pulse from the movable-backend-fence HP sensor 322, and the position of the backend tapping claw 251 is decided based on a pulse from the tapping-claw HP sensor 326. As shown in FIG. 22, while the lower conveyer rollers 72 apart from each other, the movable backend fence 73 lifts the stapled sheet set SH up to a position so that the center position, i.e., the stapled position is aligned with the folding plate 74. After that, as shown in FIG. 23, the folding plate 74 inserts the center position into between the rotating folding rollers 81 by pressing the center position in a direction perpendicular to the surface of the sheet set SH. The rotating folding rollers 81 nip the sheet set SH, and convey the sheet set SH with a pressure. Thus, the crease is made on the center of the sheet set SH.

In this manner, the stapled sheet set SH is lifted up to the target position for folding without fails only by the movement of the movable backend fence 73. In contrast to the present embodiment, if the movable backend fence 73 moves down to set the sheet set SH to the target position, there is possibility that the sheet set SH is remained higher than the target position because of friction or static charge. Therefore, to set the sheet set SH down to the target position without fails, an additional member such as a conveyer roller is required in addition to the movable backend fence 73. This disadvantageously makes the configuration more complicated.

As shown in FIG. 23, the folding plate 74 inserts the sheet set SH at the target position into the nip between the folding rollers 81*a* and 81*b*, thereby folding the sheet set SH. At the same time, the pressure-release link 570 causes an end of each of the connection members 524*a* and 524*b* to move in the sheet conveying direction by using the movable shaft 523. When the folding plate 74 is in the stand-by position, the pressure-release link 570 moves the movable shaft 523 in the direction reverse to the sheet conveying direction, thereby moving the swing arms 520*a* and 520*b* apart from each other and causing the folding rollers 81*a* and 81*b* free from the second biasing force generated by the second pressure spring 521.

As described above, when the end of each of the connection members 524*a* and 524*b* is moved in the sheet conveying direction, the swing arms 520*a* and 520*b* move closer to each other. The bearings 515*a* and 515*b* move apart from the swing arms 520*a* and 520*b*, i.e., the gaps 523*a* and 523*b* are formed. Therefore, only the first biasing force generated by the first pressure springs 512*a* and 512*b* is applied to the folding rollers 81*a* and 81*b*. In other words, the folding rollers 81*a* and 81*b* are free from the second biasing force generated by the second pressure spring 521.

When the folding plate 74 starts inserting the sheet set SH into the nip between the folding rollers 81*a* and 81*b* in the above conditions, the folding rollers 81*a* and 81*b* move apart from each other, and the bearings 515*a* and 515*b* come in contact with the swing arms 520*a* and 520*b*. When the folding plate 74 inserts the sheet set SH further, the second biasing force generated by the second pressure spring 521 is applied to the folding rollers 81*a* and 81*b* via the swing arms 520*a* and 520*b*. Thus, the folding rollers 81*a* and 81*b* press the sheet set SH with the high pressure. The second biasing force is set to be applied to a position about 3 mm away from the folded side, although the position can be fluctuated depending on the thickness of the sheet set SH. In the conditions where the high pressure is applied to the sheet set SH, the folding rollers 81*a* and 81*b* rotate and the folding plate 74 moves back from the nip position. When an edge 74*c* of the folding plate 74 moves back to a conveyer path formed with the lower conveyer guiding plate 91 (i.e., a position M shown in FIG. 27), an edge opposite to the edge 74*c* comes in contact with the pressure-release link 570, thereby moving the pressure-release link 570 backward. In the present embodiment, the position M is 25 mm away from the nip between the folding rollers 81*a* and 81*b*. By the moving-back of the pressure-release link 570, the movable shaft 523 moves back, which results in, by means of the connection members 524*a* and 524*b*, moving the swing arms 520*a* and 520*b* apart from each other. As a result, only the weak biasing force generated by the first pressure springs 512*a* and 512*b* is applied to the sheet set SH via the swing plates 511*a* and 511*b*.

The position where the sheet set SH is at that time is the re-pressing position where the re-pressing roller 409 re-presses the sheet set SH. The rotation of the folding rollers 81 stop at the re-pressing position. The re-pressing roller 409 starts sliding from the position shown in FIG. 29 up onto an end of the sheet set SH. The re-pressing roller 409 slides to the opposite end along the crease. While the re-pressing roller 409 is re-pressing the sheet set SH, the folding plate 74 moves back. When the re-pressing roller 409 slides to the opposite end, the pressure-release link 570 is returned to the stand-by position, and thereby, by means of the movable shaft 523 and the connection members 524*a* and 524*b*, the swing arms 520*a* and 520*b* are the position most apart from each other. As described above, the folding rollers 81*a* and 81*b* are free from the second biasing force generated by the second pressure spring 521. The re-pressing roller 409 starts sliding back in the conditions. The number of slides is decided based on the thickness of the sheet set SH.

Figure 24:
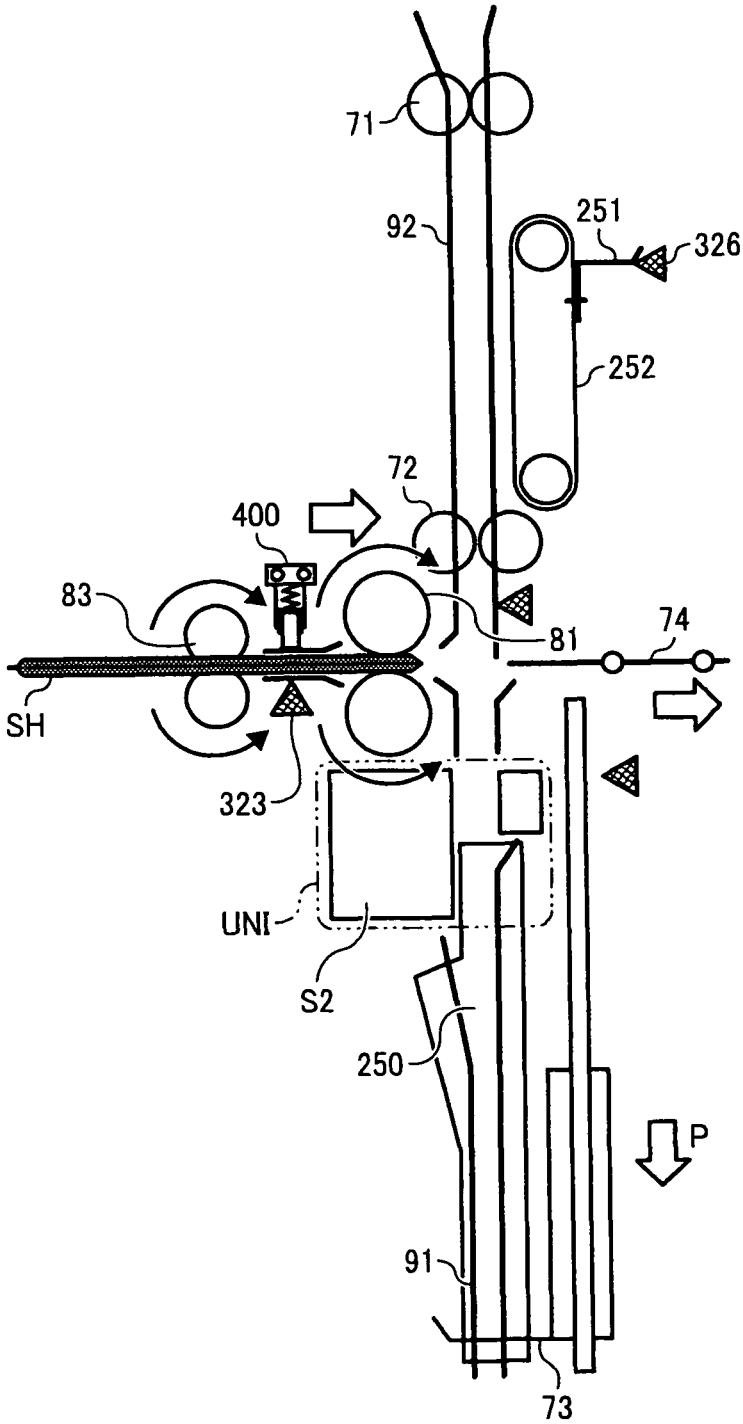
FIG. 24 is a schematic diagram for explaining operation for folding the inserted sheet set shown in FIG. 23 by using the folding rollers, and then discharging the folded sheet set.

When the re-pressing process is completed, the pressure is applied to the folding rollers 81*a* and 81*b*, and thereby the sheet set SH is conveyed downstream. As shown in FIG. 24, the folded sheet set SH is conveyed by the lower-tray sheet-discharge rollers 83 onto the lower tray 203. When the folding-unit exit sensor 323 detects passage of the trailing end of the sheet set SH, the movable backend fence 73 moves back to the HP. The pressure is applied to the lower conveyer rollers 72, i.e., the lower conveyer rollers 72 are returned to the position to convey the next sheet set SH. If the sheet size and the number of sheets of the next sheet set SH are the same as the sheet size and the number of sheets of the current sheet set SH, the movable backend fence 73 can be moved to the stand-by position as shown in FIG. 20 instead the HP.

Figure 31A:
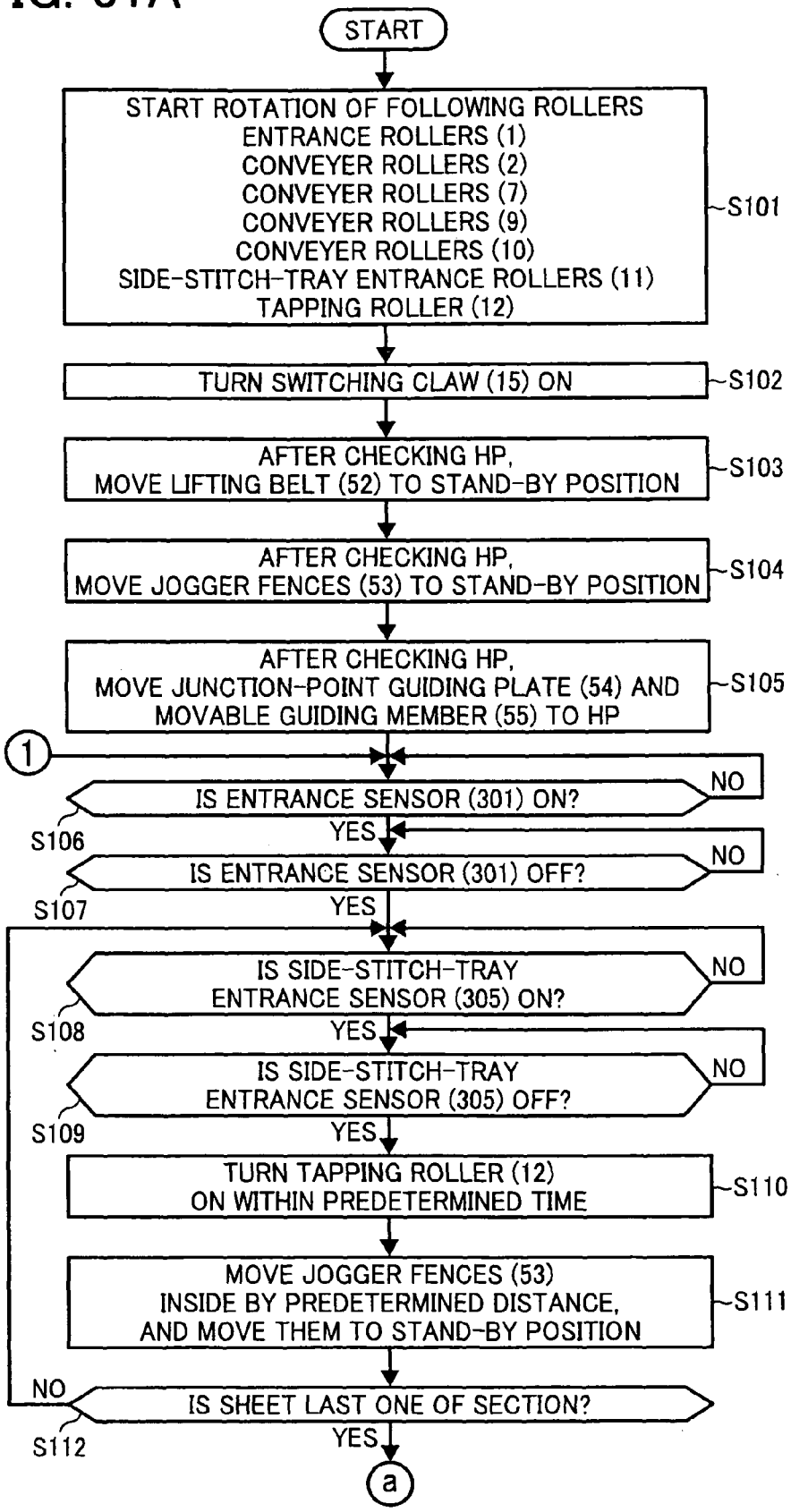
FIGS. 31A to 31E are flowcharts of a series of processes in a saddle-stitch mode according to the present embodiment.
Figure 31B:
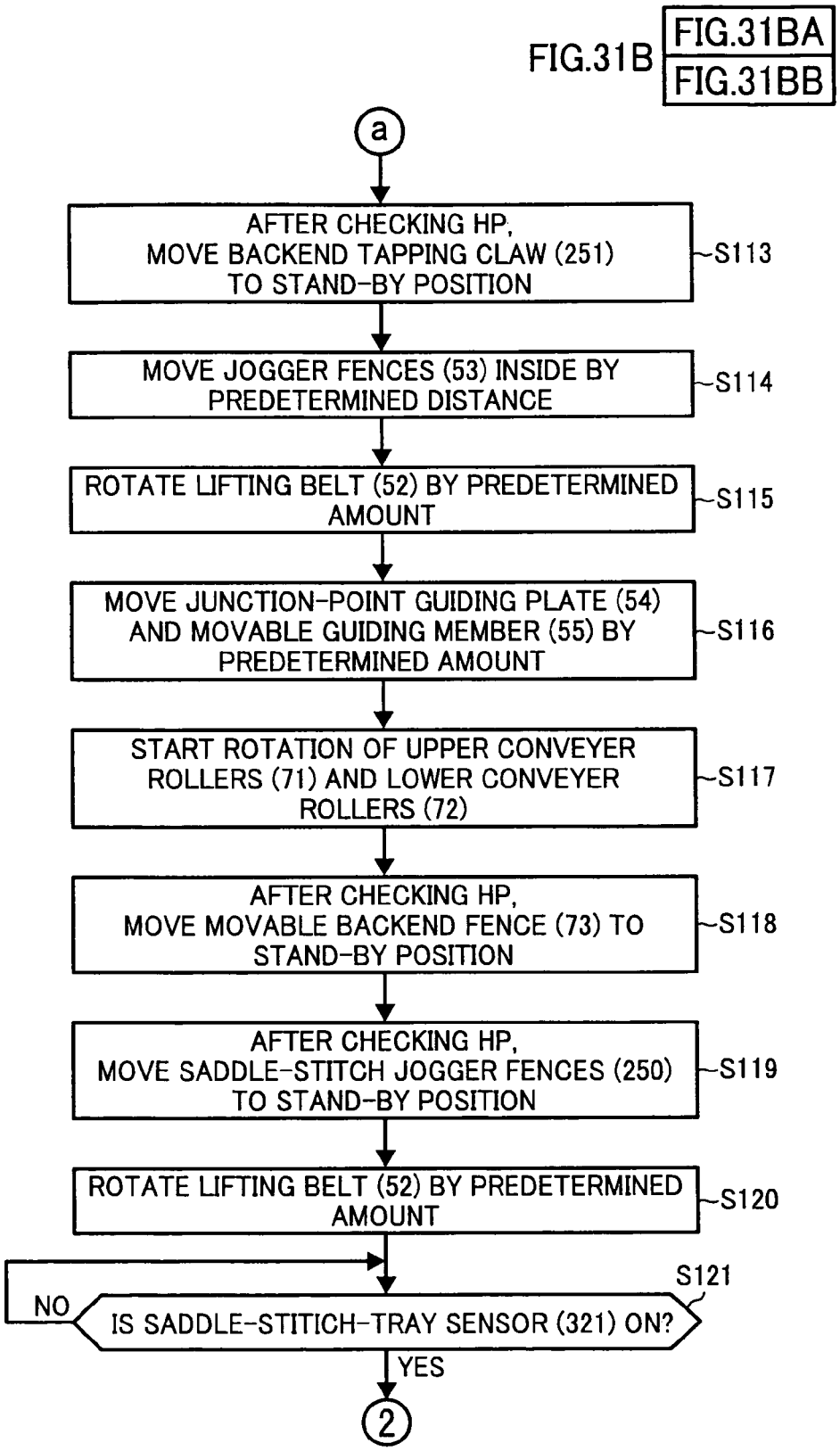
Figure 31B:
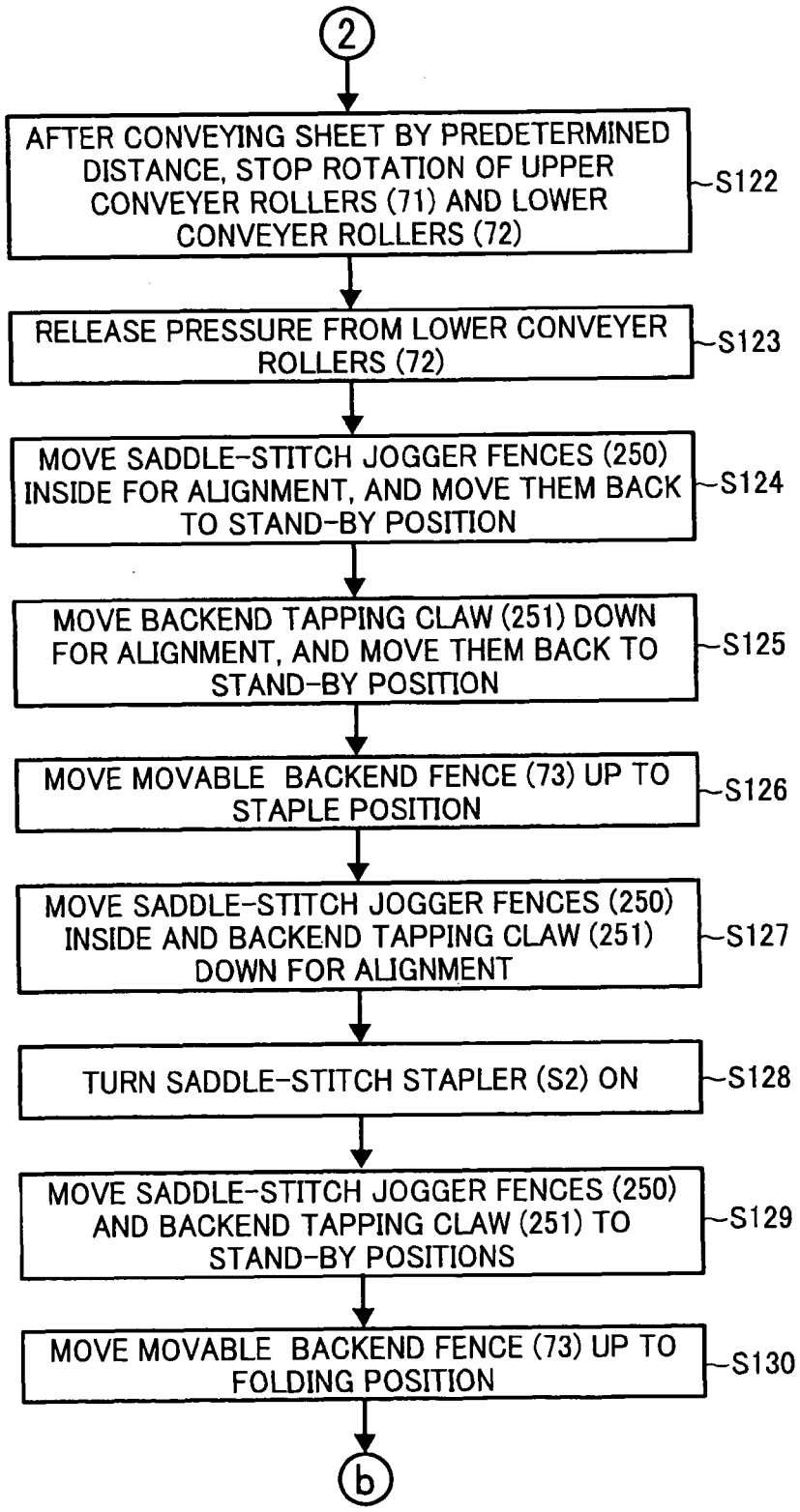
Figure 31C:
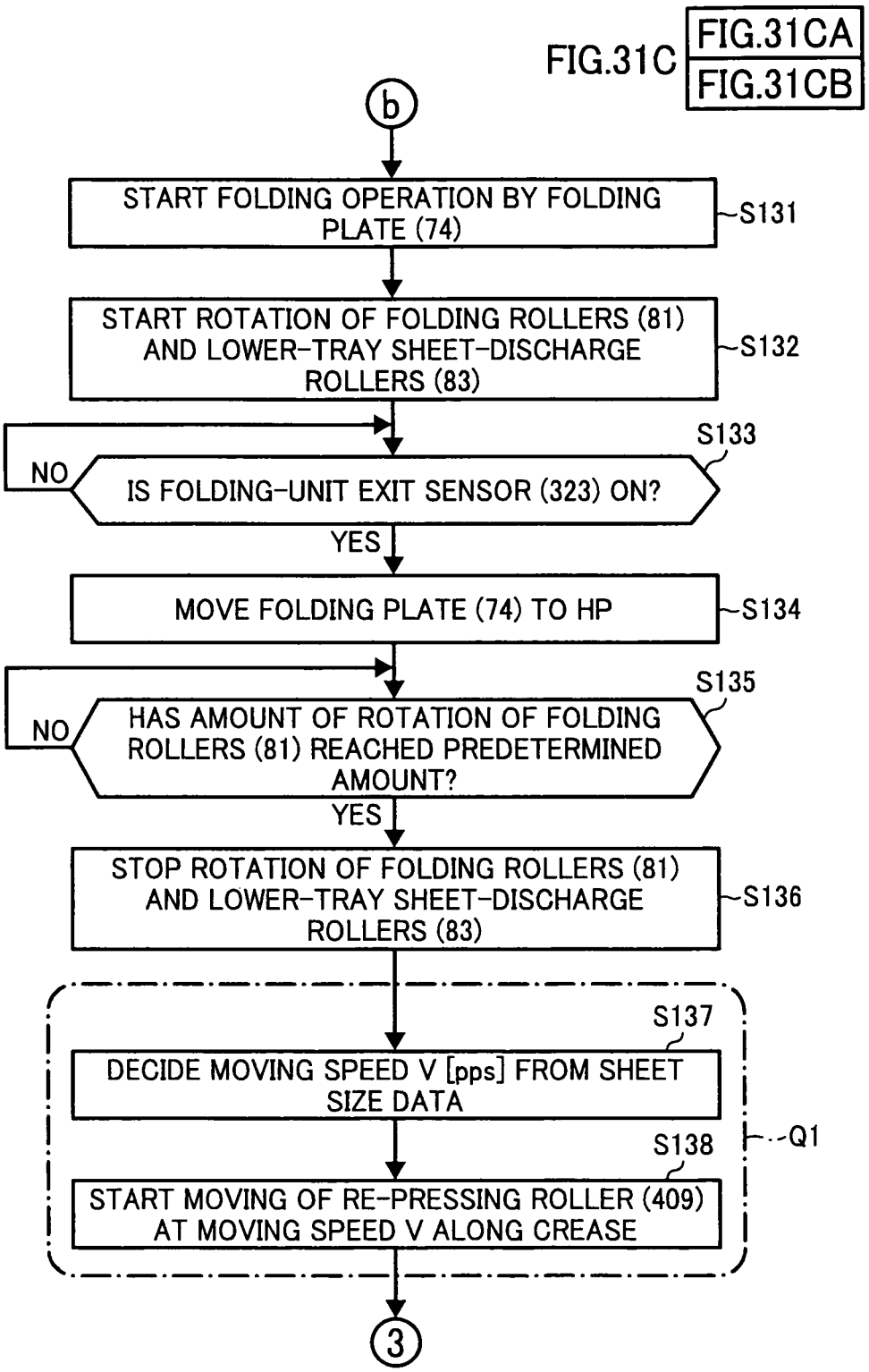
Figure 31C:
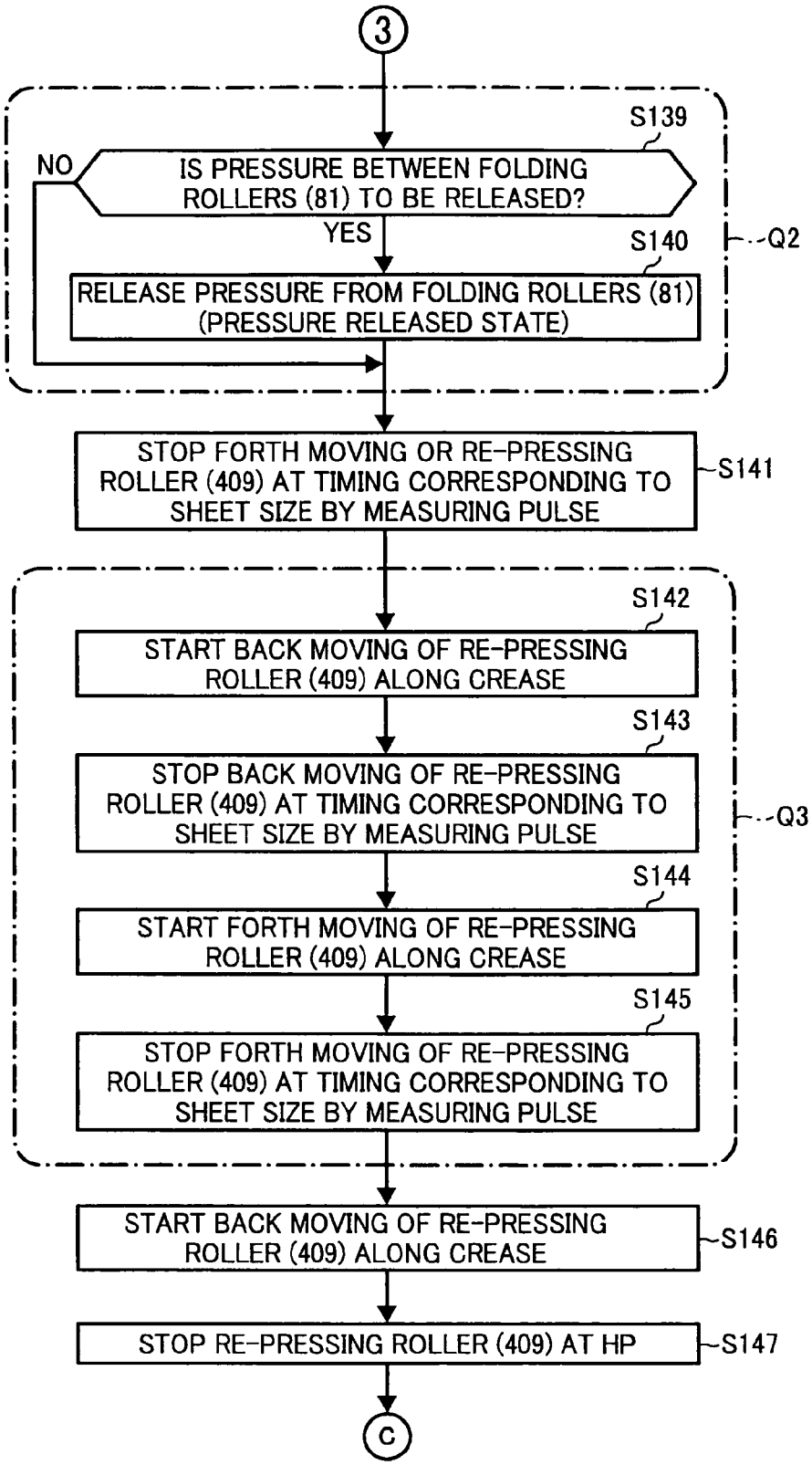
Figure 31D:
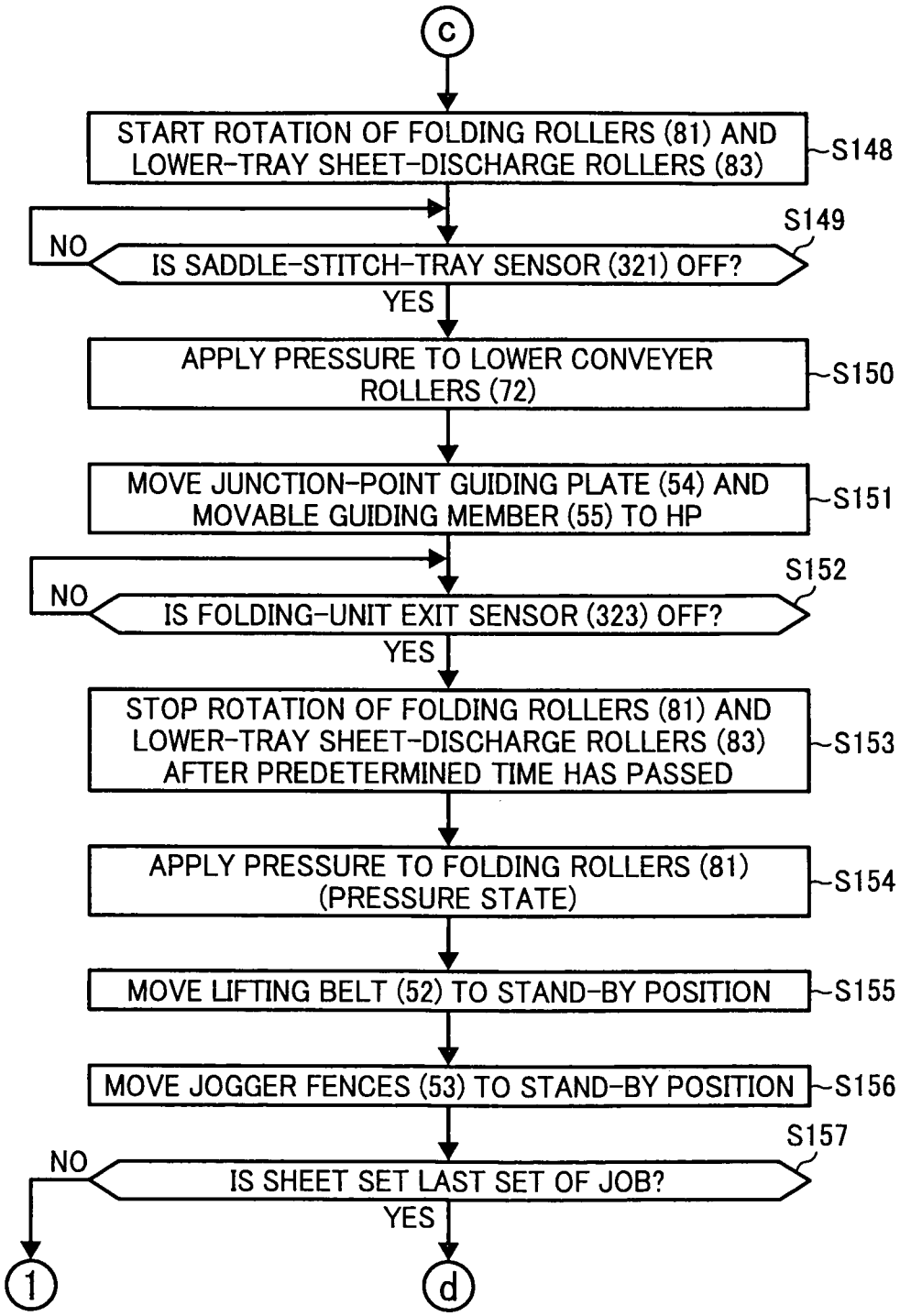
Figure 31E:
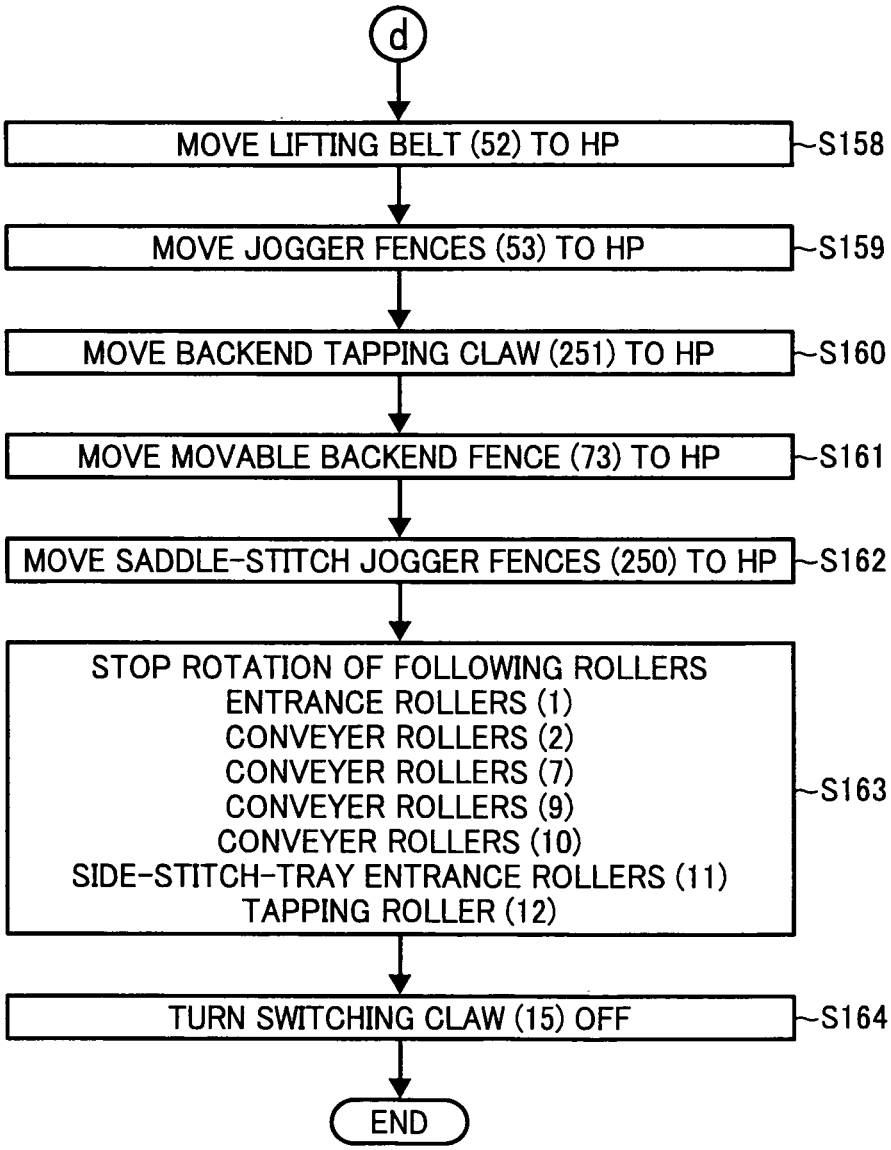

FIGS. 31A to 30E are flowcharts of a series of processes in the saddle-stitch mode.

In the saddle-stitch mode, when the sheet is conveyed from the image forming apparatus PR, the entrance rollers 1 and the conveyer rollers 2 near the conveyer path A, the conveyer rollers 7, 9, 10, and the side-stitch-tray entrance rollers 11 near the conveyer path D, and the tapping roller 12 in the side-stitch tray F start rotating (Step S101). The solenoid that drives the switching claw 15 is turned ON (Step S102), as a result of which the switching claw 15 rotates anticlockwise.

The HP of the lifting belt 52 is detected by using the lifting-belt HP sensor 311. After checking the HP, the lifting motor 157 moves the lifting belt 52 to the stand-by position. The jogger fences 53 are moved to the stand-by position after the HP of the jogger fences 53 is checked by using the jogger-fence HP sensor. The junction-point guiding plate 54 and the movable guiding member 55 are moved to their HPs (Steps S103, S104, and S105).

The entrance sensor 301 turns ON and OFF (Steps S106, S107). When the side-stitch-tray entrance sensor 305 is ON (Step S108) and the shift-tray sheet-discharge sensor 303 is OFF (Step S109), the sheet is conveyed to the side-stitch tray F. Because there is the sheet on the side-stitch tray F, the tapping SOL 170 turns ON and keeps the ON state for a predetermined time. While the tapping SOL 170 is ON, the tapping roller 12 aligns the trailing end of the sheet by coming in contact with the sheet, thereby abutting the sheet against the backend fences 51 (Step S110). The jogger motor 158 moves the jogger fences 53 inside by the predetermined distance, thereby aligning the right-and-left sides of the sheet (i.e., the sides parallel to the sheet conveying direction), and then moves the jogger fences 53 back to the stand-by position (Step S111). Thus, the top-and-bottom sides and the right-and-left sides of the sheet on the side-stitch tray F are aligned.

The series of processes from Steps S108 to S112 is repeated each time when one sheet is conveyed. When it is determined that the sheet that is subjected to the series of the processes is the last sheet (Yes at Step S112), after the HP is checked, the backend tapping claw 251 is moved to the stand-by position (Step S113). After that, the jogger fences 53 are moved inside by the predetermined distance to support the sheets so that the sheets can be conveyed with the aligned state maintained (Step S114). The lifting motor 157 rotates the lifting belt 52, with the jogger fences 53 being in the supporting position, so that the sheet set SH is conveyed near the junction-point guiding plate 54 (Step S115). The junction-point guiding plate 54 and the movable guiding member 55 are moved to form the conveyer path to the saddle-stitch tray G (Step S116).

When the conveyer path is formed, the upper conveyer rollers 71 and the lower conveyer rollers 72 start rotating to convey the sheet set SH to the saddle-stitch tray G (Step S117). After the HP is checked, the movable backend fence 73 is moved to the stand-by position (Step S118). The saddle-stitch jogger fences 250 are moved, after the HP is checked, to the stand-by position (Step S119).

When the saddle-stitch tray G is ready to receive the sheet set, the lifting belt 52 further rotates to insert the leading end of the sheet set SH between the lifting rollers 56 and the pressure roller 57 (Step S120). Thus, the sheet set SH is conveyed to the saddle-stitch tray G. When the leading end of the sheet set SH reaches the saddle-stitch-tray sensor 321 (Step S121) and then the sheet set SH is further conveyed to a position where the trailing end of the sheet set SH is out of the nip between the upper conveyer rollers 71, the rotation of the upper conveyer rollers 71 and the lower conveyer rollers 72 stop (Step S122), and the pressure is released from the lower conveyer rollers 72 (Step S123). The saddle-stitch jogger fences 250 are moved inside to align the sheet set SH. After the alignment, the saddle-stitch jogger fences 250 are moved to the stand-by position (Step S124). The backend tapping claw 251 is moved down to align the top side of the sheet set SH. After the alignment, the backend tapping claw 251 is moved back to the stand-by position (Step S125).

When the sheet set SH is aligned at Steps S124 and S125, the movable backend fence 73 is moved to the staple position (Step S126). More particularly, the movable backend fence 73 pushes up the sheet set SH to the staple position where the center of the sheet set SH is aligned with the saddle-stitch stapler S2. When the sheet set SH is at the staple position, the saddle-stitch jogger fences 250 are moved inside and the backend tapping claw 251 is moved down to the alignment positions (Step S127) to support the sheet set SH. The saddle-stitch stapler S2 staples the sheet set SH that is supported by the saddle-stitch jogger fences 250 and the backend tapping claw 251 (Step S128). After the stapling, the saddle-stitch jogger fences 250 and the backend tapping claw 251 are moved to the stand-by positions (Step S129) and the movable backend fence 73 is moved up to the folding position where the line of the sheet set SH to be folded on which the stapled position falls is aligned with the folding plate 74 (Step S130).

When the sheet set SH is moved up to the folding position, the folding operation by the folding plate 74 starts (Step S131). In synchronized with the folding operation by the folding plate 74, the rotation of the folding rollers 81 and the lower-tray sheet-discharge rollers 83 starts (Step S132). When the folding-unit exit sensor 323 detects passage of the leading end of the sheet set SH (Yes at Step S133), the folding plate 74 is moved back to the HP (Step S134). When the leasing end of the sheet set SH reaches the re-pressing position by the rotation of the folding rollers 81 (Yes at Step S135), the rotation of the folding rollers 81 and the lower-tray sheet-discharge rollers 83 stops (Step S136).

A moving speed V of the re-pressing roller 409 is, more particularly, the driving speed of the pulse motor 401 that moves the re-pressing roller 409 (i.e., the pulse number represented by pulse per second (pps)). The moving speed V is decided from the sheet size data (Step S137). The pulse motor 401 driving at the moving speed V moves the re-pressing roller 409 back and forth along the crease (Step S138). When it is determined that the pressure is to be released from the folding rollers 81 (Yes at Step S139), the pressure is released (Step S140). The pulse motor 401 stops after driving of a predetermined time equivalent to the number of pulses that is decided from the sheet size. The re-pressing roller 409 stops by the stop of the pulse motor 401 (Step S141). The re-pressing roller 409 starts moving back (Step S142). After that, the re-pressing roller 409 repeats the pulse-based move-and-stop operation corresponding to the sheet size (Steps S143, S144, S145, and S146). In other words, the re-pressing roller 409 re-presses the sheet set SH by moving back and forth several times. When the re-pressing is completed, the re-pressing roller 409 moves back to the HP (Step S147). After the re-pressing roller 409 returns to the HP, the folding rollers 81 and the lower-tray sheet-discharge rollers 83 start rotating (Step S148).

The determination at Step S139 whether the pressure is to be released is made by either the user or the CPU 360. When the user makes the determination, the user issues the instruction via the control panel of the image forming apparatus PR. When the CPU 360 makes the determination, the CPU 360 refers to the number of the sheets of the sheet set or the thickness of the sheet set. The number of the sheets is received from the image forming apparatus PR. The thickness of the sheet set, which is calculated from the distance between the upper conveyer rollers 71, is received from the measurement sensor. If the number of the sheets or the thickness of the sheet set is smaller than the reference value, the sheet set will not be deformed, even in the presence of the pressure from the folding rollers 81, to such an extent that the deformation lowers the performance of the re-pressing. Therefore, the CPU 360 determines that the pressure is not to be released. Thus, the sheet set is re-pressed by the re-pressing roller 409 in the presence of the pressure from the folding rollers 81. On the other hand, if the number of the sheets or the thickness of the sheet set is larger than the reference value, the sheet set will be deformed, in the presence of the pressure from the folding rollers 81, to such an extent shown in FIG. 28A that the deformation lowers the performance of the re-pressing. Therefore, the CPU 360 determines that the pressure is to be released. It is noted that the determination made by the user has the highest priority.

When the trailing end of the sheet set SH is passed the saddle-stitch-tray sensor 321, the saddle-stitch-tray sensor 321 turns OFF. When the saddle-stitch-tray sensor 321 turns OFF (Yes at Step S149), the pressure is applied to the lower conveyer rollers 72 (Step S150), and the junction-point guiding plate 54 and the movable guiding member 55 are moved back to the HPs (Step S151) to receive the next sheet set SH. When the trailing end of the sheet set SH is passed the folding-unit exit sensor 323, the folding-unit exit sensor 323 turns OFF (Step S152). When a predetermined time has passed since the folding-unit exit sensor 323 turns OFF, i.e., that when the sheet set SH is discharged out of the sheet finisher PD, the rotation of the folding rollers 81 and the lower-tray sheet-discharge rollers 83 stops (Step S153) and the pressure is applied to the folding rollers 81 (Step S154). Subsequently, the lifting belt 52 and the jogger fences 53 are moved to their stand-by positions (Steps S155 and S156). Whether the sheet set is the last sheet set is determined (Step S157).

If the sheet set is not the last sheet set (No at Step S157), the process control returns to Step S106 and the next sheet set is subjected to the series of the processes from Steps S106 to S157. If the sheet set is the last sheet set (Yes at Step S157), the lifting belt 52, the jogger fences 53, the backend tapping claw 251, the movable backend fence 73, the saddle-stitch jogger fences 250 are moved back to their HPs (Steps S158, S159, S160, S161, and S162), the rotation of the entrance rollers 1, the conveyer rollers 2, 7, 9, 10, the side-stitch-tray entrance rollers 11, the tapping roller 12 stops (Step S163), and the switching SOL of the switching claw 15 is turned OFF (Step S164). Thus, the process control goes to end.

According to the present embodiment, the following effects are obtained:

1) When the re-pressing roller 409 re-presses the sheet set, the sheet set is free from the unnecessary stress, because the folding rollers 81 are in a pressure-released state, so that a beautiful crease can be made. In other words, because the re-pressing roller 409 re-presses the sheet set that is folded in the non-deformed state while rolling along the crease, a strong crease can be made. It was confirmed by experiments that the strength of the crease was doubled.

2) Because the pressure is released after the re-pressing starts, the sheet set is surely supported at the start of the re-pressing, which prevents misalignment likely to occur at the start of the re-pressing.

3) The re-pressing roller 409 rolls along the crease at least from one end to the other end (hereinafter, "forth moving") and from the other end to the one end (hereinafter, "back moving"). The pressure between the folding rollers 81 is released at the end of the first forth moving. During the first back moving and afterwards, the re-pressing roller 409 re-presses the sheet set with the pressure of the folding rollers 81 being released. Therefore, unnecessary stress is not applied to the sheet set.

4) The moving speed of the re-pressing roller 409 is decided based on the data about the size of the sheet or the sheet set such that the pressure is released from the folding rollers 81 at the end of the first forth moving. Therefore, the pressure releasing is completed within the first forth moving, and the re-pressing roller 409 re-presses the sheet set with the pressure of the folding rollers 81 being released only during the first back moving and afterwards.

5) The moving speed of the re-pressing roller 409 is decided such that the time required to release the pressure is substantially equal to the time that the re-pressing roller 409 takes for the first forth moving. Therefore, the pressure releasing is completed within the first forth moving, and the re-pressing roller 409 re-presses the sheet set with the pressure of the folding rollers 81 being released during the first back moving and afterwards.

6) Whether the pressure is to be released from the folding rollers 81 before the re-pressing by the re-pressing roller 409 is determined based on the number of the sheets of the sheet set or the thickness of the sheet set. Therefore, the appropriate re-pressing manner in consideration of the substantial thickness of the sheet set is implemented.

7) The user can determine whether the pressure is to be released from the folding rollers 81 before the re-pressing by the re-pressing roller 409.

8) The determination made by the user whether the pressure is to be released is prior to the determination made by the CPU 360. Thus, the process control reflects the user's intention prior to any other determinations.

According to an aspect of the present invention, a re-pressing roller re-presses a folded side of a sheet(s), while rolling along the folded side, with the folded side in a non-swollen state. Therefore, a strong and beautiful crease can be made on the sheet(s).

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet creaser, comprising:

a pair of folding rollers that folds a sheet set including at least one sheet by pressing the sheet set in a nip portion therebetween with a nip pressure while conveying the sheet set thereby making a crease on the sheet set;

a folding plate that thrusts the sheet set in the nip portion between the folding rollers with an edge of the folding plate coming in contact with the sheet set where the sheet set is to be folded, the folding plate being arranged opposed to the folding rollers with respect to the sheet set;

a re-pressing roller that receives a folded sheet set from the folding rollers and re-presses the sheet set by rolling along the crease thereby making the crease stronger; and a pressure releasing unit that performs a pressure releasing operation of releasing the nip pressure in the nip portion between the folding rollers when the re-pressing roller re-presses the crease, wherein the pressure releasing unit moves back and forth, via a pressure control member, along a straight line corresponding with a movement of the folding plate, the pressure control member releases the pressure from the nip between the pair of folding rollers by setting a pair of swing arms to a pressure-release position, the pair of swing arms are connected to a movable shaft that is located downstream in a sheet conveyance direction in which the respective swing arms are connected to the movable shaft via a pair of connection members, a range of movement of the movable shaft corresponds to a length of a guide hole in the pressure control member which is in a direction parallel to the movement of the folding plate, and controls a range of movement of the pair of swing arms, and the pressure releasing unit starts the pressure releasing operation after the re-pressing roller starts re-pressing the crease.

2. The sheet creaser according to claim 1, wherein the re-pressing roller makes at least one back-and-forth movement along the crease, and the pressure releasing unit completes the pressure releasing operation while the re-pressing roller makes a first forth movement so that the nip pressure is in released state while the re-pressing roller makes subsequent movements.

3. The sheet creaser according to claim 2, further comprising a speed setting unit that sets a moving speed of the re-pressing roller in the first forth movement based on information about a size of the sheet set and a time required for the pressure releasing operation.

4. The sheet creaser according to claim 3, wherein the speed setting unit sets the moving speed such that a time required for the first forth movement is substantially equal to the time required for the pressure releasing operation.

5. The sheet creaser according to claim 1, further comprising a determining unit that determines whether or not, after the re-pressing roller starts re-pressing, the pressure releasing operation is to be performed based on information on at least one of number of sheets in the sheet set and thickness of the sheet set.

6. The sheet creaser according to claim 1, further comprising a setting unit that sets whether or not, after the re-pressing roller starts re-pressing, the pressure releasing operation is to be performed.

7. The sheet creaser according to claim 1, further comprising:

a determining unit that determines whether the pressure releasing operation is to be performed based on information on at least one of number of sheets in the sheet set and thickness of the sheet set; and a setting unit that sets whether or not the pressure releasing operation is to be performed, wherein setting made by the setting is given priority over a determination made by the determining unit.

8. A sheet finisher comprising the sheet creaser according to claim 1.

9. An image forming apparatus comprising the sheet creaser according to claim 1.

10. An image forming apparatus comprising the sheet finisher according to claim 8.

* * * * *